US012704033B2

(12) United States Patent
McCullough et al.

(10) Patent No.: US 12,704,033 B2
(45) Date of Patent: Aug. 11, 2026

(54) CLUTCH ASSEMBLY FOR A DRILL STRING AND RELATED METHODS

(71) Applicant: NTS AMEGA WEST USA, INC, Houston, TX (US)

(72) Inventors: Robert McCullough, Parkland County (CA); Everett Hagar, Devon (CA); Lisa Ying Pui Yung, Edmonton (CA)

(73) Assignee: NTS AMEGA WEST USA, INC, Houston, TX (US)

( * ) Notice: Subject to any disclaimer, the term of this patent is extended or adjusted under 35 U.S.C. 154(b) by 31 days.

(21) Appl. No.: 18/887,497

(22) Filed: Sep. 17, 2024

(65) Prior Publication Data

US 2026/0078645 A1 Mar. 19, 2026

(51) Int. Cl.
*E21B 21/10* (2006.01)

(52) U.S. Cl.
CPC ..... *E21B 21/103* (2013.01)

(58) Field of Classification Search
CPC ..... E21B 21/103
See application file for complete search history.

(56) References Cited

U.S. PATENT DOCUMENTS 4,299,296 A 11/1981 Geczy
4,632,193 A * 12/1986 Geczy ..... E21B 21/103 166/301
4,971,158 A 11/1990 Salmi
5,181,576 A 1/1993 Askew et al.
5,421,421 A 6/1995 Appleton
(Continued)

FOREIGN PATENT DOCUMENTS

CA 2561036 A1 10/2005
CA 2568053 A1 5/2007
(Continued)

OTHER PUBLICATIONS

"CasingSwivel"—Rubicon Oilfield International. (n.d.). May 8, 2018-Nov. 7, 2021. Retrieved Oct. 27, 2022. Rubicon Oilfield International. https://web.archive.org/web/20181220165500/http://www.rubicon-oilfield.com:80/products/casingswivel/.
(Continued)

*Primary Examiner* — Yanick A Akaragwe
(74) *Attorney, Agent, or Firm* — ALG Intellectual Property, LLC

(57) ABSTRACT

A clutch assembly for use in a wellbore and connectable between a first and second drill string sections is provided. The clutch assembly includes a first assembly portion connectable to the first drill string section and a second assembly portion connectable to the second drill string section. The second assembly portion comprises a driveshaft. The clutch assembly further comprises a releasable clutch mechanism that selectively rotationally locks the first assembly portion with the second assembly portion. The clutch assembly may comprises a one-way bearing assembly allowing rotation of the driveshaft relative to the first assembly portion in a first rotational direction and preventing rotation of the driveshaft in a second rotational direction opposite to the first rotational direction. The clutch assembly may comprise a diverter valve mechanism having an open configuration and a closed configuration.

24 Claims, 15 Drawing Sheets

(56) References Cited

U.S. PATENT DOCUMENTS

| | | | | |
|---|---|---|---|---|
| 5,617,926 | A * | 4/1997 | Eddison | E21B 23/006 175/61 |
| 5,738,178 | A | 4/1998 | Williams et al. | |
| 6,082,457 | A | 7/2000 | Best et al. | |
| 6,158,533 | A | 12/2000 | Gillis et al. | |
| 6,227,313 | B1 | 5/2001 | Davis et al. | |
| 6,328,119 | B1 | 12/2001 | Gillis et al. | |
| 6,439,321 | B1 | 8/2002 | Gillis et al. | |
| 6,446,737 | B1 | 9/2002 | Fontana et al. | |
| 6,571,888 | B2 | 6/2003 | Comeau et al. | |
| 6,679,341 | B2 | 1/2004 | Bloom et al. | |
| 6,918,452 | B2 | 7/2005 | Chan et al. | |
| 7,178,611 | B2 | 2/2007 | Zupanick | |
| 7,467,658 | B2 | 12/2008 | Kent et al. | |
| 7,467,672 | B2 | 12/2008 | Cruickshank | |
| 7,481,282 | B2 | 1/2009 | Horst et al. | |
| 7,607,495 | B2 | 10/2009 | Bloom et al. | |
| 7,673,708 | B2 | 3/2010 | Lee | |
| 7,681,650 | B2 | 3/2010 | Telfer et al. | |
| 7,987,927 | B2 | 8/2011 | Downton | |
| RE42,877 | E | 11/2011 | Lirette et al. | |
| 8,307,921 | B2 | 11/2012 | Eddison | |
| 8,448,722 | B2 | 5/2013 | Konschuh et al. | |
| 8,776,915 | B2 | 7/2014 | Beylotte et al. | |
| 8,789,579 | B2 | 7/2014 | Ollerenshaw et al. | |
| 8,869,916 | B2 | 10/2014 | Clausen et al. | |
| 9,016,400 | B2 | 4/2015 | Clausen et al. | |
| 9,187,955 | B2 | 11/2015 | Beylotte et al. | |
| 9,376,865 | B2 | 6/2016 | Kirkhope et al. | |
| 9,637,977 | B2 | 5/2017 | Giroux et al. | |
| 9,797,204 | B2 | 10/2017 | Kirkhope | |
| 10,047,573 | B2 | 8/2018 | Kadam et al. | |
| 10,066,438 | B2 | 9/2018 | Kirkhope et al. | |
| 10,273,753 | B2 | 4/2019 | Marland et al. | |
| 10,280,700 | B2 | 5/2019 | Moyes | |
| 10,358,903 | B2 | 7/2019 | Smith | |
| 10,597,943 | B2 | 3/2020 | Wheeler et al. | |
| 10,648,265 | B2 | 5/2020 | Kinsella et al. | |
| 10,883,316 | B2 | 1/2021 | Samuel et al. | |
| 10,968,722 | B2 | 4/2021 | Buckland et al. | |
| 11,136,842 | B2 | 10/2021 | Beach et al. | |
| 11,525,318 | B2 | 12/2022 | Shen et al. | |
| 11,686,156 | B2 | 6/2023 | Munguia et al. | |
| 11,802,462 | B2 | 10/2023 | Churchill | |
| 11,867,013 | B2 | 1/2024 | Caminari | |
| 12,000,228 | B2 | 6/2024 | Stokes et al. | |
| 2007/0012440 | A1 | 1/2007 | Lee | |
| 2007/0151737 | A1 * | 7/2007 | Begley | E21B 21/103 166/324 |
| 2008/0236481 | A1 | 10/2008 | Petersen et al. | |
| 2011/0214963 | A1 | 9/2011 | Beylotte et al. | |
| 2011/0284292 | A1 | 11/2011 | Gibb et al. | |
| 2013/0248203 | A1 | 9/2013 | Scott et al. | |
| 2013/0313022 | A1 | 11/2013 | Kirkhope et al. | |
| 2014/0231144 | A1 | 8/2014 | Sonar et al. | |
| 2014/0284110 | A1 | 9/2014 | Savage et al. | |
| 2017/0030149 | A1 * | 2/2017 | Kadam | F16D 3/12 |
| 2017/0234081 | A1 | 8/2017 | Kirkhope et al. | |
| 2018/0163509 | A1 | 6/2018 | Churchill | |
| 2020/0263507 | A1 | 8/2020 | Crowther et al. | |
| 2023/0295988 | A1 | 9/2023 | Mccullough et al. | |
| 2024/0084651 | A1 | 3/2024 | Crowley et al. | |

FOREIGN PATENT DOCUMENTS

| | | | |
|---|---|---|---|
| CA | 2494237 | C | 3/2008 |
| CA | 3009888 | A1 | 7/2017 |
| CA | 2995267 | A1 | 9/2018 |
| EP | 1398455 | B1 | 3/2004 |
| EP | 2923025 | A1 | 9/2015 |
| EP | 3397832 | A1 | 11/2018 |
| WO | 2011109075 | A2 | 9/2011 |
| WO | 2019100116 | A1 | 5/2019 |
| WO | 2021151189 | A1 | 8/2021 |

OTHER PUBLICATIONS

Arrival Technology Forum Featuring Mud Motors, "Rotary Bottom Hole Assemblies," Nov. 1, 2018. International Association of Directional Drilling.

Halliburton Sperry Drilling. (n.d.). "Operator Drills Gulf of Thailand's Longest Openhole Production Section in One Run". 2018. In Quasar Trio (Case Study No. HAL123807). https://cdn.brandfolder.io/VUJJLY3X/at/3jgvkz8p2stjvp5rxgwznx/Thailand_QuasarTrio_HT_H012985_CS.pdf.

Ryan, J., et al. Nov. 13, 2017. "Casing Swivel Tool Greatly Expands Liner Deployment Capability in the Giant Offshore Oil Field Abu Dhabi Resulting in a World Record Single-Run 6⅝ Inch Lower Completion". https://doi.org/10.2118/188783-ms.

International Search Report received in PCT Application No. PCT/US2025/046728 on Nov. 26, 2025.

* cited by examiner

CLUTCH ASSEMBLY FOR A DRILL STRING AND RELATED METHODS

TECHNICAL FIELD

The present disclosure relates to drilling systems. More particularly, the present disclosure relates to clutch assemblies and relating methods for drilling boreholes.

BACKGROUND

To access subterranean deposits of resources such as oil and gas, a borehole may be drilled into an earth formation using a drill string. A typical drill string comprises a bottomhole assembly (BHA) including a drill bit that drills the borehole and a length of drill pipe that extends from BHA to a drilling rig at the surface. Drilling a borehole may include non-directional drilling and/or directional drilling. Directional drilling is required for drilling deviated or horizontal boreholes. Directional drilling typically involves the use of a BHA that includes a steerable drilling system, such as a rotary steerable drilling tool or a steerable drilling motor.

As the borehole is drilled, the drill bit will start to wear, which may lead to sections of the borehole being narrower than required ("undergauge"). Undergauge sections of the borehole may also occur due to "caving" of the borehole or if drill cuttings become stuck or compressed on the BHA, which causes poor circulation of drilling fluids. When the drill string is pulled ("tripped") out of the borehole, the drill pipe may get stuck at an undergauge section, which places significant stress on the BHA, including expensive components such as a rotary steerable. While good drilling practice and proper BHA selection help to mitigate this issue, "pumping out" and/or "back reaming" are often still required to try to remove a stuck drill pipe.

FIG. 1A is a side view schematic of a portion of a conventional drill string 10 in a horizontal section of a borehole 11. The drill string 10 in this example comprises drill pipe 12 (only a portion of which is shown in FIG. 1A) and a BHA 14 including a drill bit 13 and stabilizers 15. During normal drilling operations, the drill string 10 is rotated while drilling fluid ("mud") is pumped downhole through the drill pipe 12 to the drill bit 13. The drilling fluid is circulated back uphole through an annulus 16 between the drill string 10 and the sidewall of the borehole 11. Drill cuttings 17 will settle along the bottom of the borehole 11, below the drill string 10.

During a typical tripping out procedure, the drill string 10 is pulled in the uphole direction, as indicated by arrow "A", without rotation or circulation. If a tight spot is encountered, rotation and circulation are reinitiated, and the BHA will act as a conveyor to move cuttings 17 uphole. After a short period (e.g., 30 minutes), circulation and rotation will cease again and the drill string 10 will be carefully pulled out of hole while monitoring for other obstructions.

FIG. 1B shows the drill string 10 and borehole 11 of FIG. 1A during a typical back reaming procedure. During back reaming, the drill string 10 is rotated while it is pulled uphole (as indicated by arrows B in FIG. 1B) and drilling fluid is pumped through the drill pipe 12 at a drilling flow rate to help disperse the cuttings 17 above the BHA 14. Cuttings 17 will gradually drop out to form a dune 18 above the BHA 14. The BHA 14 will be gradually advanced uphole using torque to monitor the pulling speed of the drill string 10. However, back reaming may still place considerable stress on the BHA.

FIG. 2 is a side view of a portion of a conventional drill string 20 with a "mud motor above rotary steerable" (MARS) BHA 21. The BHA 21 includes a mud motor 22, a driveshaft 23, instrument collars 24, and a "push the bit" rotary steerable system (RSS) 25 configured to steer the drilling direction of a drill bit 26. The RSS 25 comprises biasing pads 27 that are activated by the flow of drilling fluid through the BHA 21. The drill bit 26 is operated by rotation of the drill string 10 as well as by the flow of drilling fluid through the mud motor 22, which is operably to drive rotation of the drill bit 26 to increase the RPM (revolutions per minute).

If rotation of the drill string 10 rotation stops, but fluid is still flowing through the mud motor 22, the drill bit 26 still turns and the biasing pads 27 still inflate, which generates drag on the BHA 21. Therefore, in conventional drill strings, trip out and back reaming procedures may subject the BHA 21, including the RSS 25, to destructive forces.

SUMMARY

According to an aspect, there is provided a clutch assembly for use in a wellbore and connectable between a first drill string section and a second drill string section, the clutch assembly comprising: a first assembly portion connectable to the first drill string section; a second assembly portion connectable to the second drill string section and comprising a driveshaft, the first assembly portion and the second assembly portion collectively defining a fluid passage therethrough from a first end of the clutch assembly to a second end of the clutch assembly; a releasable clutch mechanism that selectively rotationally locks the first assembly portion with the second assembly portion, the first assembly portion comprising a first coupling element of the clutch mechanism, and the second assembly portion comprising a second coupling element of the clutch mechanism, the second coupling element being selectively engageable with the first coupling element; a one-way bearing assembly allowing rotation of the driveshaft relative to the first assembly portion in a first rotational direction and preventing rotation of the driveshaft in a second rotational direction opposite to the first rotational direction.

In some embodiments, the clutch assembly further comprises a diverter valve mechanism having an open configuration, in which at least some fluid within the fluid passage is diverted to an annulus between the assembly and the wellbore, and a closed configuration in which the fluid is not diverted to the annulus.

In some embodiments, the first drill string section is above the clutch assembly and the second drill string section is below the clutch assembly, and wherein the first assembly portion is an upper subassembly coupled to the first drill string section, and the driveshaft is coupled to the second drill string section.

In some embodiments: the upper subassembly comprises a housing, wherein the driveshaft is at least partially received in the housing; the first coupling element is rotationally locked with the driveshaft; and the second coupling element is rotationally locked with the housing and axially movable between an engaged configuration in which the second coupling element engages the first coupling element such that the driveshaft is rotationally locked with the housing, and a disengaged configuration in which the second coupling element is disengaged from the first coupling element such that the driveshaft is rotatable relative to the housing.

In some embodiments, the upper subassembly comprise an actuation mechanism, the actuation mechanism comprising at least one actuation member coupled to the second coupling element and selectively movable between first and second longitudinal positions within the housing to thereby axially move the second coupling element between the engaged and disengaged configurations.

In some embodiments, the movement of the at least one actuation member between the first and second longitudinal positions further actuates the diverter valve mechanism between the opened and closed configurations.

In some embodiments: the at least one actuation member comprises a pushrod defining a pushrod passage axially therethrough, and an actuation piston coupled to the pushrod, the actuation piston and the pushrod being movable between the first and second longitudinal positions, the actuation piston defining a piston passage axially therethrough, the fluid passage including the pushrod passage and the piston passage; the actuation mechanism further comprises a biasing mechanism that provides a biasing force that biases the pushrod and the actuation piston in an uphole direction.

In some embodiments, the actuation piston comprises a seat for landing a plug member to block fluid flow through the fluid passage and create a pressure differential that, at a first pressure threshold, overcomes the biasing force and moves the pushrod and actuation piston in a downhole direction.

In some embodiments, the seat is configured to release the plug member at a second pressure threshold, wherein the second pressure threshold is higher than the first pressure threshold.

In some embodiments, the seat comprises a deformable collar that deforms at a second pressure threshold to release the plug member.

In some embodiments, the plug member comprises a deformable material such that the plug member deforms and passes through the seat at a second pressure threshold, wherein the second pressure threshold is higher than the first pressure threshold.

In some embodiments: the actuation piston comprises a piston sleeve within a section of the housing, the valve mechanism comprising the piston sleeve and the section of the housing, wherein: the piston sleeve defines one or more piston ports extending radially through the piston sleeve and in fluid communication with the piston passage; the section of the housing defines one or more housing ports extending radially through the section of the housing; when the pushrod and the actuation piston are in the first longitudinal position, the valve mechanism is in the closed configuration with each of the one or more piston ports axially offset from a respective one of the one or more housing ports such that each of the one or more piston ports is not in fluid communication with the respective housing port; and when the pushrod and the actuation piston are in the second longitudinal position, the valve mechanism is in the opened configuration with each of the one or more piston ports is aligned with the respective one of the one or more housing ports such each of the one or more piston ports is in fluid communication with the respective housing port.

In some embodiments, the actuation mechanism further comprises a latch mechanism that releasably holds the at least one actuation member in the first and second longitudinal positions.

According to another aspect, there is provided a clutch assembly for use in a wellbore and connectable between a first drill string section and a second drill string section, the assembly comprising: a first assembly portion connectable to the first drill string section; a second assembly portion connectable to the second drill string section, the first assembly portion and the lower assembly portion collectively defining a fluid passage therethrough from a first end of the clutch assembly to a second end of the clutch assembly; a releasable clutch mechanism coupling the first and second assembly portions, the first assembly portion comprising a first coupling element of the clutch mechanism, and the second assembly portion comprising a second coupling element of the clutch mechanism, the second coupling element being selectively engageable with the first coupling element, wherein: the first assembly portion comprises; an actuation member coupled to the second coupling element and selectively movable between first and second longitudinal positions to thereby axially move the second coupling element between the engaged and disengaged configurations, the actuation member defining an actuation member passage therethrough, the fluid passage through the clutch assembly including the actuation member passage; a biasing mechanism that provides a biasing force that biases the actuation member in an uphole direction; and a plug catch portion comprising a seat for landing and releasably holding a plug member to block fluid flow through the actuation member passage and create a pressure differential that, at a first pressure threshold, overcomes the biasing force and moves the actuation member in a downhole direction.

In some embodiments, the first assembly portion is an upper subassembly, and the first drill string section is above the clutch assembly, and wherein the second assembly portion comprises a driveshaft, and the second drill string section is below the clutch assembly.

In some embodiments, the seat is configured to release the plug member at a second pressure threshold, wherein the second pressure threshold is higher than the first pressure threshold, wherein the seat comprises a deformable collar that deforms at a second pressure threshold to release the plug member.

In some embodiments, the plug member comprises a deformable material that deforms and passes through the seat at a second pressure threshold, wherein the second pressure threshold is higher than the first pressure threshold.

In some embodiments, the clutch assembly further comprises a diverter valve mechanism having an open configuration, in which at least some fluid within the fluid passage is diverted to an annulus between the assembly and the wellbore, and a closed configuration in which the fluid is not diverted to the annulus, wherein the diverter valve mechanism comprises one or more ports in fluid communication with the annulus and the actuation member passage when the diverter valve mechanism is in the open configuration.

In some embodiments, the plug seat is positioned uphole of the one or more ports.

According to another aspect, there is provided a method of using the clutch assembly as described herein, the method comprising: performing a drilling operation with the clutch mechanism engaged; and disengaging the clutch mechanism.

In some embodiments: the clutch assembly further comprises a diverter valve mechanism having an open configuration, in which at least some fluid within the fluid passage is diverted to an annulus between the assembly and a wellbore, and a closed configuration in which the fluid is not diverted to the annulus; the step of performing the drilling operation with the clutch mechanism engaged comprises performing the drilling operation with the clutch mechanism engaged and the diverter valve mechanism in the closed configuration; and the step of disengaging the clutch mechanism comprises disengaging the clutch mechanism and actuating the diverter valve mechanism from the closed configuration to the open configuration.

In some embodiments: the assembly comprises an actuation mechanism comprising an actuation piston, the actuation piston comprising a seat; and disengaging the clutch mechanism comprises landing a plug member on the seat, thereby blocking fluid flow through the fluid passage and causing pressure above the seat to meet a first pressure threshold.

In some embodiments, disengaging the clutch mechanism further comprises releasing the plug member from the seat when the pressure meets a second pressure threshold higher than the first pressure threshold, thereby resuming the fluid flow through the fluid passage.

In some embodiments, the method further comprises re-engaging the clutch mechanism and actuating diverter valve mechanism to the closed configuration.

Other aspects and features of the present disclosure will become apparent, to those ordinarily skilled in the art, upon review of the following description of the specific embodiments of the disclosure.

BRIEF DESCRIPTION OF THE DRAWINGS

Some aspects of the disclosure will now be described in greater detail with reference to the accompanying drawings. In the drawings.

DETAILED DESCRIPTION

Aspects of the present disclosure provide clutch assemblies and related methods for use in downhole operations.

As used herein the terms "a," "an", and "the" may include plural referents unless the context clearly dictates otherwise.

In this disclosure, the term "upward" may be used to refer to the "uphole" direction, where the "uphole" direction refers to the direction toward the surface in a borehole or well. The term "downward" may be used to refer to the "downhole" direction, where the "downhole" direction refers to the direction toward the bottom (or toe) of the borehole or well (i.e., opposite to the uphole direction). Such terms are used for ease of description and illustrative purposes and do not limit implementation or operation of the assemblies and apparatuses described herein to a particular orientation.

As used herein, the terms "engaged" or "coupled" are intended to encompass components that are directly connected to one another as well as components that are indirectly connected with one or more other components therebetween, unless the context clearly dictates otherwise.

The clutch assemblies disclosed herein may be incorporated into drill string including, for example, as part of a bottom-hole assembly (BHA). The BHA may be any suitable BHA in the art. In some embodiments, the assembly is incorporated into a BHA that includes a rotary steerable system (RSS). In some embodiments, the assembly is incorporated into a "mud motor above rotary steerable" (MARS) BHA.

Figure 1A:
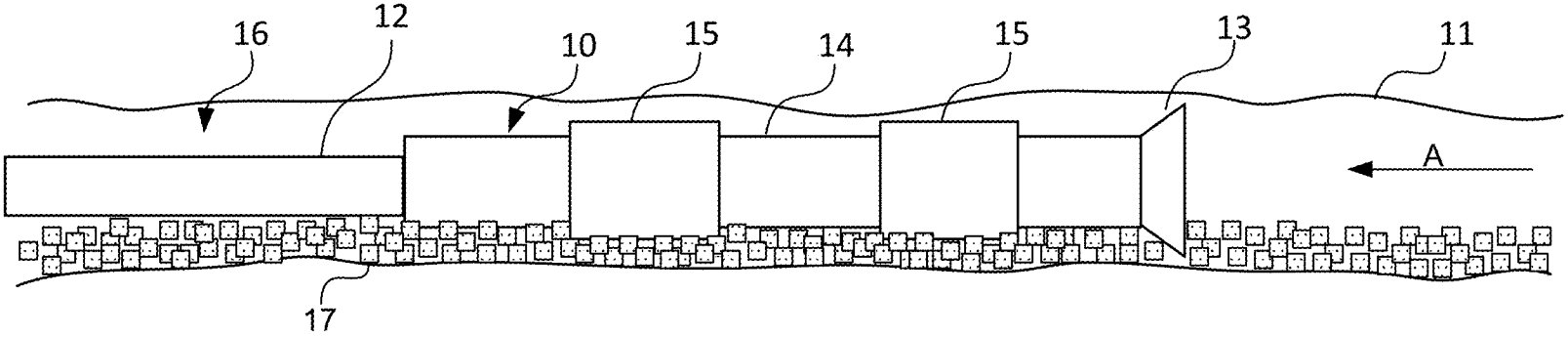
FIG. 1A (Prior Art)
FIG. 1A is a side view schematic of a portion of a prior art drill string in a horizontal section of a borehole during a tripping out procedure.
Figure 1B:
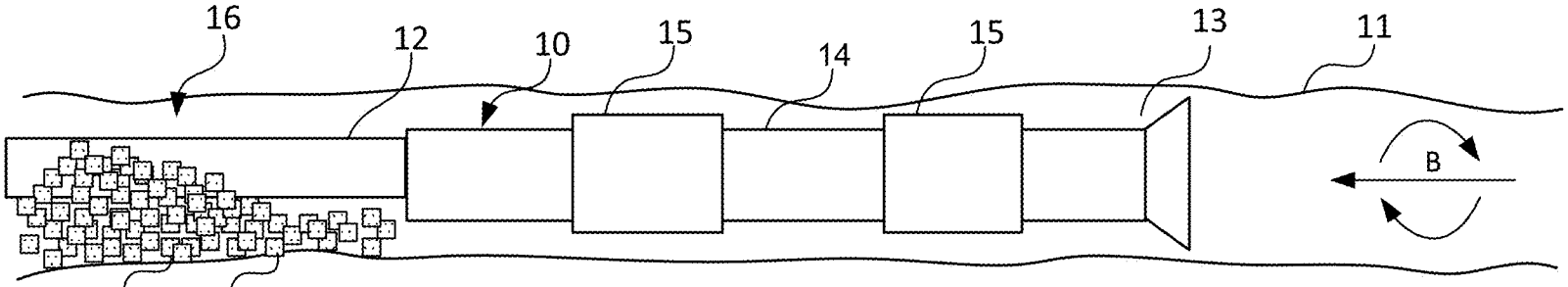
FIG. 1B (Prior Art)
FIG. 1B is a side view schematic of the drill string and the borehole of FIG. 1A during a back reaming operation.
Figure 2:
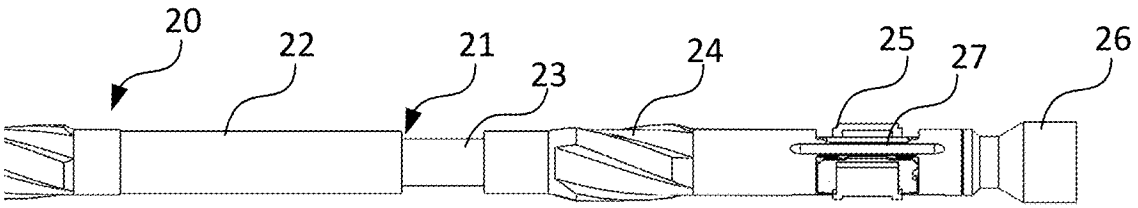
FIG. 2 (Prior Art)
FIG. 2 is a partial side view of a prior art "mud motor above rotary steerable" (MARS) bottom hole assembly (BHA)
Figure 3:
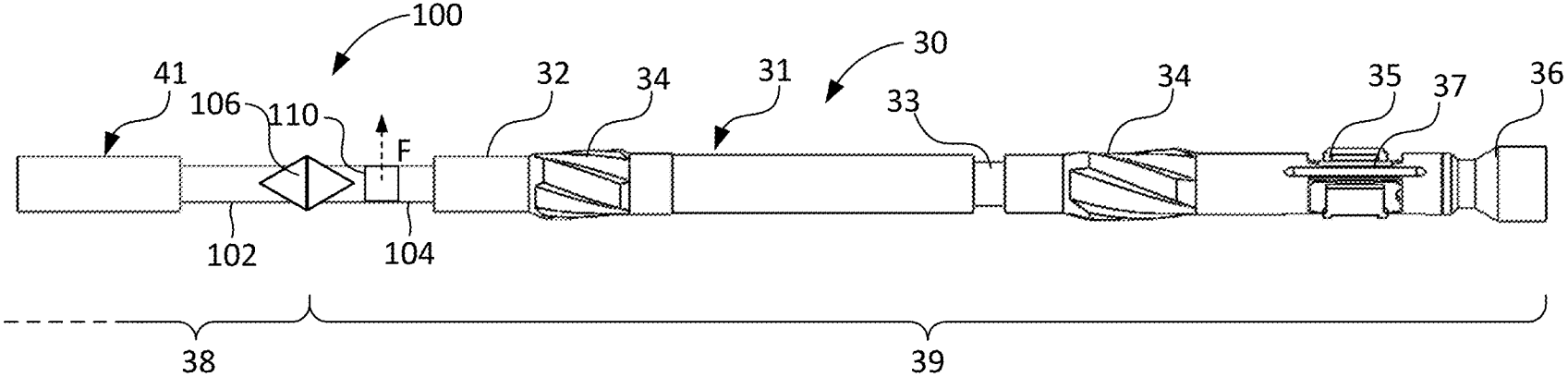
FIG. 3 is a simplified partial side view schematic of a portion of drill string with a MARS BHA including an example clutch assembly.

FIG. 3 is a side view schematic of a portion of a drill string 30 with a MARS BHA 31 including a clutch assembly 100 described in Applicant's U.S. application Ser. No. 17/977,678, published as U.S. Patent App. Pub. No. 2023/

0295988, filed Oct. 31, 2022, the entire contents of which are incorporated herein by reference. The drill string 30 is configured to be positioned in a borehole (not shown) with an annulus therebetween. The drill string 30 comprises a mud motor 32, a driveshaft 33, instrument collars 34, and a "push the bit" RSS 35 configured to steer the drilling direction of a drill bit 36. The RSS 35 comprises biasing pads 37. Biasing pads 37 may, for example, be extend outward by rotating about a hinge. An axial passage (not shown) extends through the BHA 31 to convey drilling fluid to the RSS 35 and the drill bit 36. A clutch assembly 100 is connected intermediate the BHA 31 and an uphole drill string section 41. The BHA 31 in this context may be referred to as a downhole drill string section, relative to the assembly 100. An uphole end of the assembly 100 is connected to the uphole drill string section 41 and the downhole end of the assembly 100 connected to the downhole drill string section (BHA 31 in this example). The uphole and downhole drill string sections may comprise other various equipment instead of, or in addition to the example equipment shown in FIG. 3.

The assembly 100 comprises an upper assembly portion 102, and a lower assembly portion 104, and a clutch mechanism 106 that selectively rotationally locks the upper assembly portion 102 with the lower assembly portion 104. The term "rotationally locked" or "rotationally coupled" as used herein refers to two elements coupled such that rotation of one of the elements (an "input element") is transferred to the other of the elements (the "output element") and they rotate together. The clutch mechanism 106 is positioned uphole of the lower assembly portion 104. The clutch mechanism 106 and the upper and lower assembly portions 102 and 104 are shown in a simplified manner in FIG. 3A for illustrative purposes only and their structure is described in more detail in U.S. application Ser. No. 17/977,678.

The clutch mechanism 106 effectively divides the drill string 30 into an uphole portion 38 (i.e., the portion of the drill string 30 extending upwards of the clutch mechanism 106 towards the drilling rig) and a downhole portion 39 (i.e., the remainder of the drill string 30 extending downhole of the clutch mechanism 106 to the drill bit 36). The clutch mechanism 106 couples the uphole portion 38 to the downhole portion 39 and is movable between an engaged position and a disengaged position. When the clutch mechanism 106 is in the engaged position, the downhole portion 39 of the drill string 30 is engaged with the uphole portion 38 such that rotation of the uphole portion 38 rotates the downhole portion 39. When the clutch mechanism 106 is in the disengaged position, the uphole portion 38 and the downhole portion 39 are disengaged such that the uphole portion 38 rotates independently of the downhole portion 39.

The lower assembly portion 104 includes a diverter valve mechanism 110 that is actuatable between an open state and a closed configuration. In the open configuration, the diverter valve mechanism 110 is open and allows fluid communication between the axial passage and the annulus between the drill string 30 and the borehole such that fluid in the axial passage of the BHA is at least partially diverted into the annulus. In the closed configuration, the diverter valve mechanism 110 is closed and does not allow communication of fluid between the axial passage and the annulus, such that the fluid flows through the assembly 100 to the RSS 35 and the drill bit 36 without being diverted to the annulus.

The assembly 100 also comprises an actuation mechanism 112 (shown in FIG. 18) operatively connected to the clutch mechanism 106 and the diverter valve mechanism 110. The actuation mechanism is selectively actuatable to move the clutch mechanism 106 between the engaged position and the disengaged position and to move the diverter valve mechanism 110 between the closed configuration and the open configuration.

During normal drilling operations, the clutch mechanism 106 is in the engaged position and the diverter valve mechanism 110 is in the closed state. The downhole portion 39 of the drill string 30 rotates with the uphole portion 38, aided by the mud motor 32, and drilling fluid flows through the BHA to the biasing pads 37 of the RSS 35 and the drill bit 36.

To switch from normal drilling to a tripping out or back reaming procedure, the actuation mechanism may be actuated to move the clutch mechanism 106 to the disengaged position and the diverter valve mechanism 110 to the open configuration. With the clutch mechanism 106 in the disengaged position, the BHA 31 from the mud motor 32 to the drill bit 36 no longer rotates with the uphole portion 38 of the drill string 30. The diverter valve mechanism 110 is in the open configuration such that at least a portion of the drill fluid is diverted to the annulus as indicated by arrow "F" in FIG. 3. By diverting fluid flow to the annulus, flow to the biasing pads 37 of the RSS 35 may be substantially reduced, thereby reducing the drag on the BHA 31 as the drill string is pulled uphole. By reducing drag, the stress on the BHA 31 is therefor reduced, thereby preventing or reducing damage to the BHA 31 (including the expensive RSS 35) while the drill string 30 is pulled uphole.

As the mud motor 32, the RSS 35, and the drill bit 36 are all connected in the downhole portion 39, if fluid flow is only partially diverted to the annulus, the remaining fluid will flow through the mud motor 32 to the RSS 35 and the drill bit 36, which may allow the mud motor 32 to continue to rotate the RSS 35 and the drill bit 36 independently of the uphole portion 38. The assembly 100 may therefore be particularly useful in certain applications where it is desirable to reduce the drag on the BHA while still allowing some rotation of the RSS 35 and the drill bit 36.

While the clutch mechanism 106 is in the engaged position, torque from the rotating uphole portion 38 of the drill string 30 can transfer through to the mud motor 32 and the drill bit 36. There may be an equal and opposite reaction from the drill bit 36 back to the uphole portion 38, making the forces equal. However, when the clutch mechanism 106 is in the disengaged position, the mud motor 32 is not rotationally coupled to the uphole portion 38 of the drill string 30. As a result, torque absorbed by the drill bit 36 can potentially drive the mud motor 32 in the opposite direction, which is referred to herein as "backdriving" and may result in damage to the biasing pads 37. By way of example, if the drilling direction is clockwise, backdriving may cause the RSS 35 to rotate in the counter-clockwise direction, which can cause significant damage to the pads 37. Thus, it may be desirable to prevent such backspin due to torque in the BHA 31 or other components downhole of the clutch mechanism 106.

Figure 4:
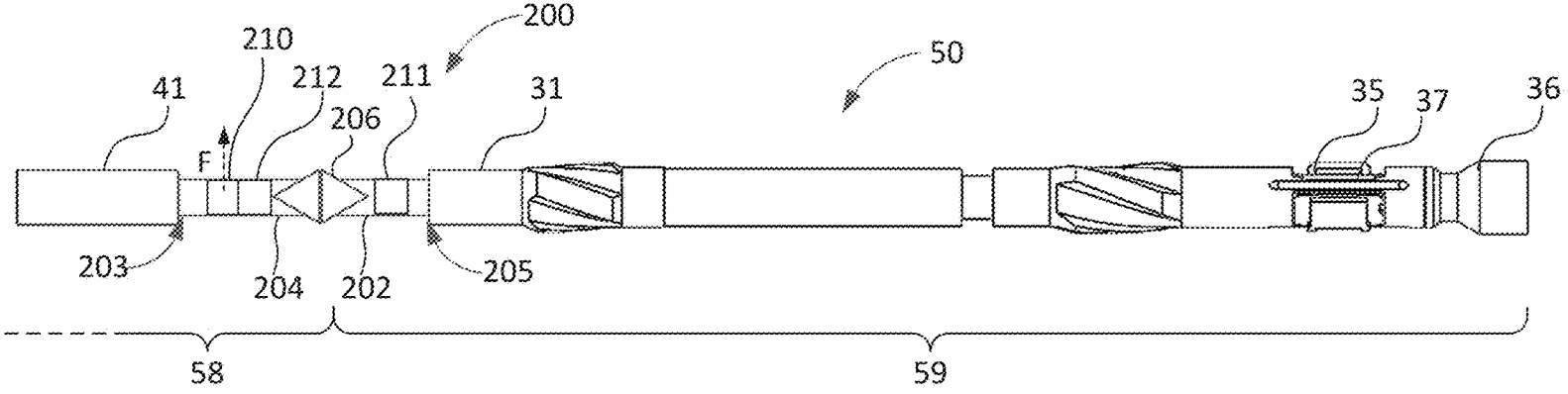
FIG. 4 is a simplified partial side view schematic of a portion of the drill string of FIG. 3 including another alternative clutch assembly according to some embodiments of the present disclosure.

FIG. 4 is a side view schematic of a portion of a drill string 50 having the uphole drill string section 41 and downhole drill string section comprising the BHA 31. In FIG. 4, an example assembly 200 according to some embodiments interconnects those drill string sections (41 and 31). The assembly 200 in this example may prevent or reduce the risk of backdriving or backspinning of components of the drill string downhole of the assembly 200 when the clutch mechanism 206 is disengaged. Reducing or preventing backdriving may, in turn, prevent or reduce damage to pads of an RSS bit, for example.

The assembly 200 generally comprises an upper assembly portion, a lower assembly portion and a releasable clutch mechanism 206 that selectively rotationally couples the upper and lower assembly portions. The lower assembly portion comprises a driveshaft 202 and the upper assembly portion is an upper subassembly 204. The term "driveshaft" as used herein may refer to any mandrel or shaft-like structure, including but not limited to a tubular structure, that is rotationally driven may transmit mechanical power and/or torque via rotation to one or more other components of the drill string.

As will be explained below, the clutch mechanism 206 has an engaged configuration and a disengaged configuration. The clutch mechanism 206 effectively divides the drill string 50 into an uphole drill string portion 58 (i.e., the portion of the drill string 30 extending upwards of the clutch mechanism 106 towards the drilling rig) and a downhole drill string portion 59 (i.e., the remainder of the drill string 50 extending downhole of the clutch mechanism 206 to the drill bit 36).

The assembly 200 has an uphole end 203 and a downhole end 205. The driveshaft 202 is connectable to the BHA 31 at its downhole end 205, and the upper subassembly 204 is connectable to the uphole drill string section 41 at its uphole end 203. When the clutch mechanism 206 is engaged, the uphole drill string portion 58 and the downhole drill string portion 59 rotate together. In other words, in the engaged configuration, the uphole drill string portion 58 and the downhole drill string portion 59 are rotationally coupled with one another. When the clutch mechanism 206 is disengaged, the uphole drill string portion 58 and downhole drill string portion 59 are rotatable relative to one another.

A fluid passage 207 (visible in FIG. 5) extends axially through the assembly 200 from the uphole end 203 to the downhole end 205. More specifically, the upper subassembly 204 and the driveshaft 202 collectively define a fluid passage 207 therethrough from the uphole end 203 to the downhole end 205. The fluid passage 207 extends through the assembly 200 generally along the longitudinal axis 201 to allow fluid. Drilling fluid (or other fluid) may flow through the fluid passage 207 to equipment connected downhole of the assembly 200, such as the RSS 35 and the drill bit 36 shown in FIG. 4. The fluid passage 207 extends generally axially through the assembly 200 in this example, but embodiments are not limited to the fluid passage strictly following a central longitudinal axis, and the passage may deviate from the axial direction.

The assembly 200 further comprises a diverter valve mechanism 210 and an actuation mechanism 212 (represented as functional blocks in FIG. 4). The actuation mechanism 212 and the clutch mechanism 206 are held within a housing 208 (shown in FIG. 5) in this example embodiment. The driveshaft 202 is also at least partially received in the housing 208 as will be explained below. The housing 208 may rotate with the upper drill string section connected thereto and may transmit rotation to the driveshaft 202 when the clutch mechanism 206 is engaged.

The valve mechanism 210 is has an open configuration and a closed configuration. In the open configuration, at least some fluid flowing within the fluid passage is diverted to an annulus between the housing 208 and the wellbore as indicated by arrow "F" in FIG. 4. In the closed configuration, the fluid is not diverted to the annulus.

The clutch mechanism 206 may comprise a first coupling element and a second coupling element that is movable to releasably engage the first coupling element. In the assembly 200, the driveshaft 202 comprises the first coupling element and the upper subassembly 204 comprises the second coupling element, as will be described below.

The actuation mechanism 212 in this embodiment controls both the valve mechanism 210 and the clutch mechanism 206 together such that: in the first position, the clutch mechanism 206 is engaged and the valve mechanism 210 is closed; and in the second position, the clutch mechanism 206 is disengaged and the valve mechanism 210 is opened. Thus, when the clutch mechanism 206 is engaged, full fluid flow through the fluid passage 207 may be provided to a mud motor or other equipment in the downhole drill string portion. When the clutch mechanism 206 is disengaged, the valve mechanism 210 may divert at least some fluid to the annulus, so that the mud motor (or other equipment) is not driven or is not fully driven. In other embodiments, the clutch mechanism 206 and the valve mechanism 210 may be sequentially and/or independently actuated by two different actuation mechanisms, such as electric motors, for example.

Unlike the assembly 100 of FIG. 3, the actuation mechanism 212 is part of the uphole drill string portion 58, rather the downhole drill string portion 59. The actuation mechanism 212 is coupled to the clutch mechanism 206 and is actuatable to move the clutch mechanism 206 between the engaged and disengaged configurations and to move the diverter valve mechanism 210 between the open and closed configurations.

The assembly 200 further comprises a one-way bearing assembly 211 engaging the driveshaft 202 in this example. The one-way bearing assembly 211 may allow rotation of the driveshaft 202 in a first rotational direction (e.g. a drilling direction) relative to the upper subassembly 204 and prevent rotation of the driveshaft 202 in a second rotational direction opposite to the first rotational direction. The one-way bearing assembly 211 is positioned downhole of the clutch mechanism 206 in this example. In other embodiments, the one-way bearing assembly 211 may be omitted.

The driveshaft 202, the upper subassembly 204, the clutch mechanism 206, the valve mechanism 210, and the one-way bearing assembly 211 are shown in a simplified manner in FIG. 4 for illustrative purposes only. An example implantation of the assembly 200 of FIG. 4 will be described in more detail with reference to FIGS. 5 to 15.

Figure 5:
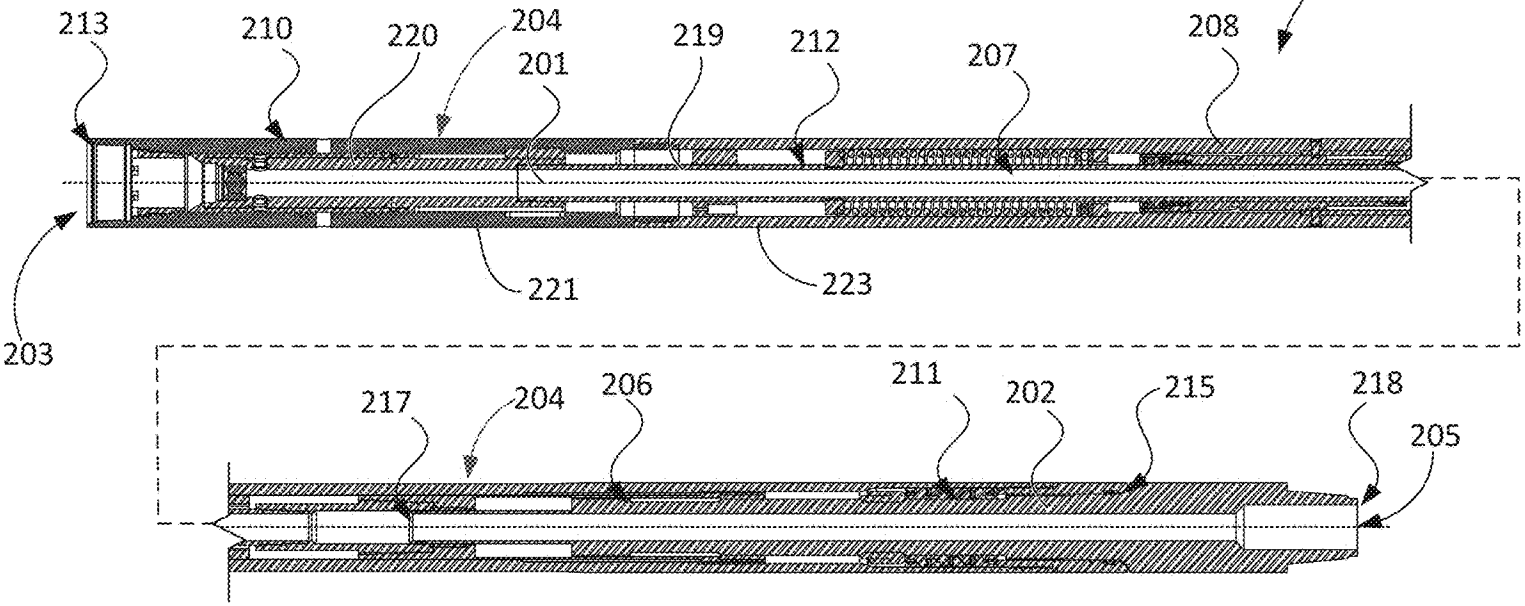
FIG. 5 is a side, cross-sectional view of the clutch assembly of the drill string of FIG. 4.

FIG. 5 is a side cross-sectional view of the assembly 200 of FIG. 4 including the driveshaft 202, the upper subassembly 204, the clutch mechanism 206 and the one-way bearing assembly 211. The upper subassembly 204 may also be referred to herein as "an upper assembly portion". The driveshaft 202 may also be referred to herein as "a lower assembly portion", with the clutch mechanism 206 operable to selectively rotationally couple the upper and lower assembly portions. A will be appreciated by the skilled person, the upper assembly portion and lower assembly portions (functionally coupled by the clutch mechanism) may have other configurations than the example assembly 200 of FIG. 5. For example, one or more other components may be connected to the driveshaft 202. As another example, one or more components of the upper subassembly 204 may be located below the clutch mechanism 206 in other embodiments. Other variations are also within the scope of the disclosure while still applying the principles described herein.

The upper subassembly 204 and the driveshaft 202 share a longitudinal axis 201 and collectively define a fluid passage 207 axially therethrough. The driveshaft defines an axial bore 224 therethrough, which forms a portion of the fluid passage 207. Components of the upper subassembly 204 that will be described below provide the remainder of the fluid passage 207 extending axially through the assembly 200. As used herein, the terms "axial" and "longitudinal" are intended to refer to the approximate direction of the longitudinal axis 201.

The upper subassembly 204 is connectable to an uphole drill string section. The driveshaft 202 is connectable to a downhole drill string section (such as BHA 31 in FIG. 4). The upper subassembly 204 in this embodiment comprises a generally tubular housing 208 having an upper housing end 213 and a lower housing end 215. The upper housing end 213 is at the uphole end 203 of the assembly 200. The driveshaft 202 has an upper driveshaft end 217 and lower driveshaft end 218 and is partially received in the housing 208 through the downhole end 205. The lower driveshaft end 218 is at the downhole end 205 of the assembly 200. The uphole housing end 213 and the lower driveshaft end 218 are configured to connect the assembly 200 to uphole and downhole components of the drill string respectively. The upper housing end 213 and/or the lower driveshaft end 218 may, for example, comprise connectors such as threaded sections or any other connecting structures. The housing 208 may be a single integral tubular body such as a sleeve, or the housing 208 may comprise two or more housing segments coupled together. In this embodiment, the housing 208 comprises upper and lower housing sections 221 and 223 connected together.

Figure 9:
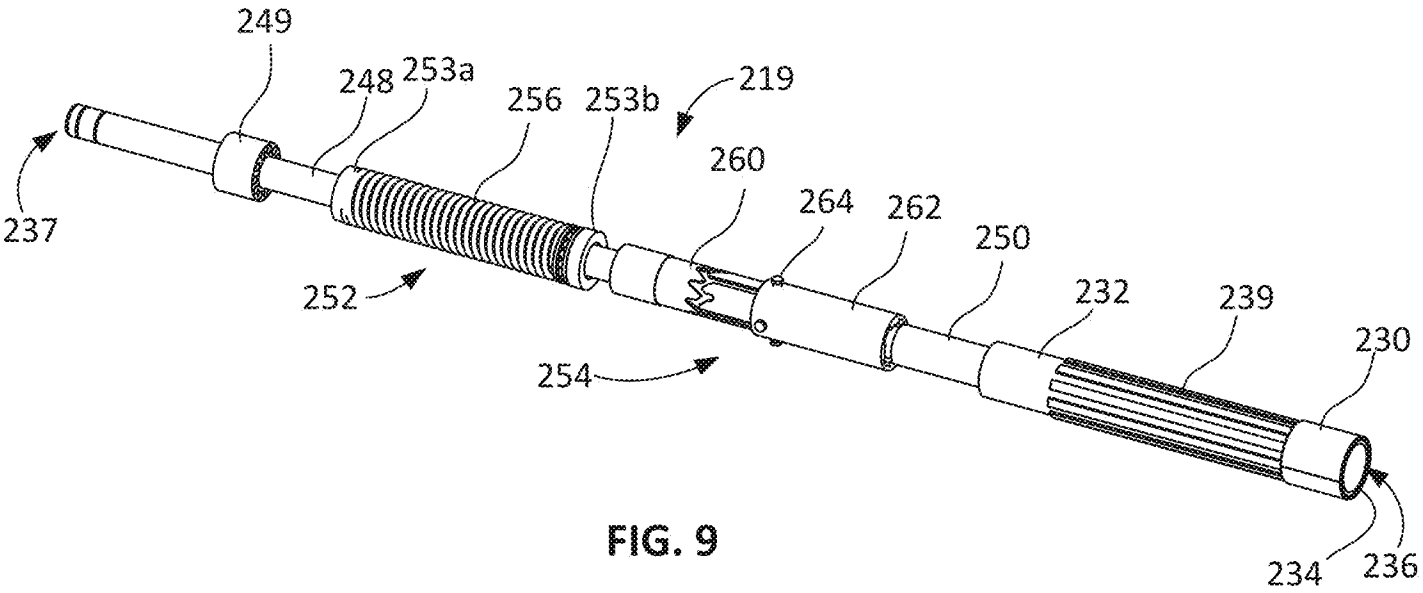
FIG. 9 is a perspective view of a pushrod assembly of the clutch assembly of FIG. 5 according to some embodiments, with the clutch shuttle of FIGS. 7A to 7C attached to the pushrod assembly.

The actuation mechanism 212 may comprise an actuator member coupled to the clutch mechanism 206 and axially movable between a first longitudinal position in which the clutch mechanism 206 is engaged and a second longitudinal position in which the clutch mechanism is disengaged. In this embodiment, the at least one actuation member comprises a tubular pushrod 248 and an actuation piston 220. The pushrod 248 is positioned intermediate the clutch mechanism 206 and the actuation piston 220. The actuation piston 220 is, thus, positioned uphole of the pushrod 248. The actuation piston 220 is also a component of the valve mechanism 210 in this embodiment, as will be explained below. The actuation piston 220 may also be referred to as a "port shuttle". The pushrod 248 and the actuation piston 220 define a passage longitudinally therethrough and are axially movable together between the first and second longitudinal positions within the housing 208 for actuating the clutch mechanism 206 and the valve mechanism 210. The pushrod 248 together with other components of the actuation mechanism 212 may be referred to as "pushrod assembly 219" herein, which is best shown in FIG. 9 and described below.

Figure 6A:
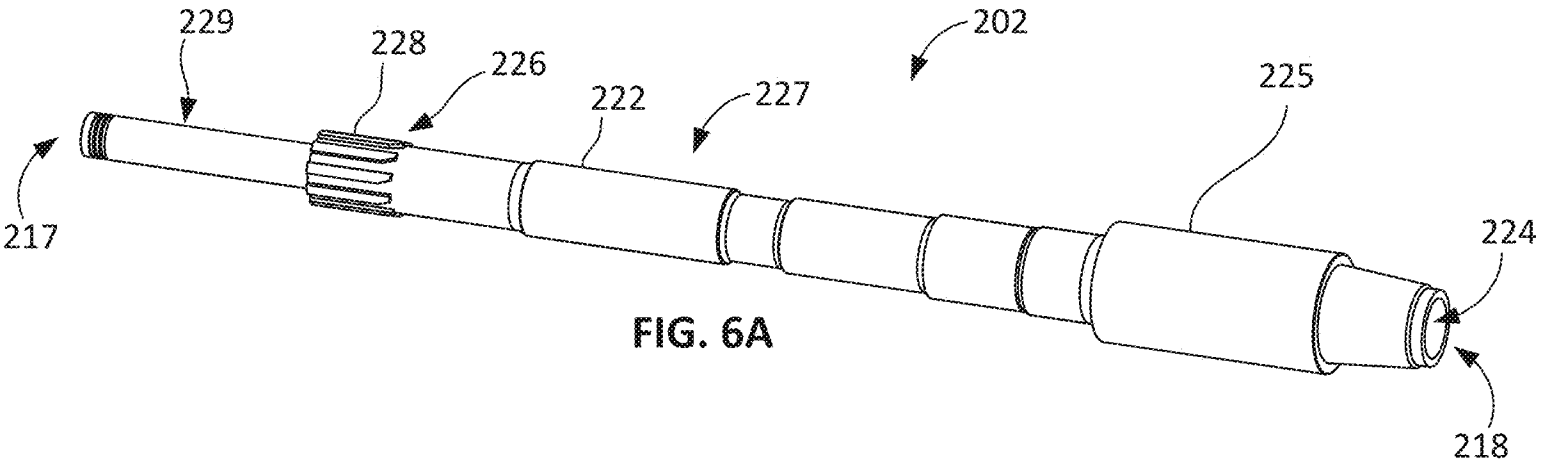
FIGS. 6A and 6B are perspective and side views, respectively, of a driveshaft of the clutch assembly of FIG. 5 according to some embodiments.
Figure 6B:
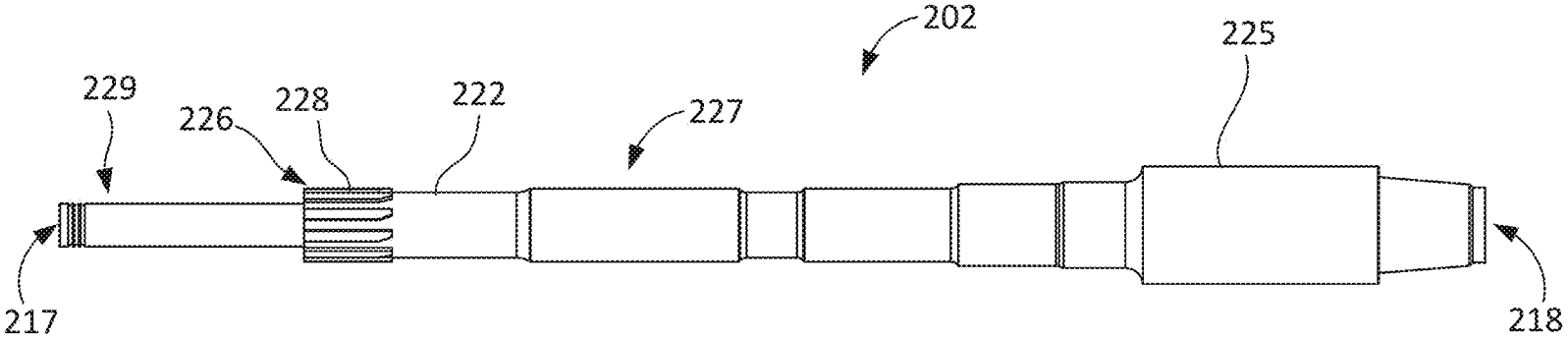

FIGS. 6A and 6B are perspective and side views, respectively, of the driveshaft 202. The driveshaft 202 has an outer surface 222 defines an axial bore 224 that extends longitudinally through the driveshaft 202. The axial bore 224 forms part of the overall fluid passage 207 through the assembly 200. The driveshaft 202 includes a base 225 (at the lower driveshaft end 218) and a mandrel portion 227 extending from the base 225. A first coupling element of the clutch mechanism 206 is formed by the mandrel portion 227 of the driveshaft 202 in this embodiment. Specifically, the first coupling component comprises a spline gear 226 defined by the driveshaft 202. The spline gear 226 comprises male splines 228 defined by the outer surface of the mandrel portion 227. The male splines 228 are spaced from the upper driveshaft end 217 such that a top portion 229 of the mandrel portion 227 extends past the male splines 228. The male splines 228 are integral with the driveshaft 202 in this embodiment and form a male gear. However, splines or another form of coupling element may be secured to or formed on the driveshaft in any suitable manner such that the driveshaft 202 and the first coupling element are rotationally coupled together.

Figure 7A:
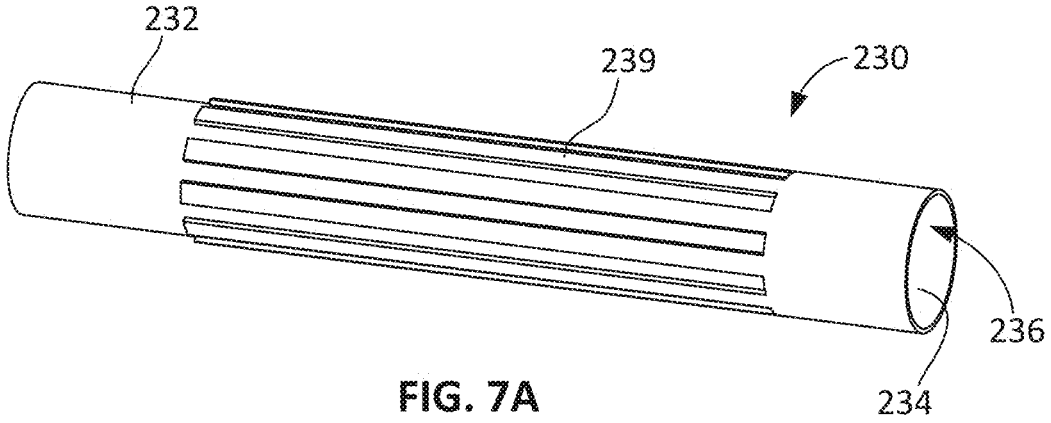
FIGS. 7A and 7B are perspective and side views, respectively, of a clutch shuttle of the clutch assembly of FIG. 5 according to some embodiments.
Figure 7B:
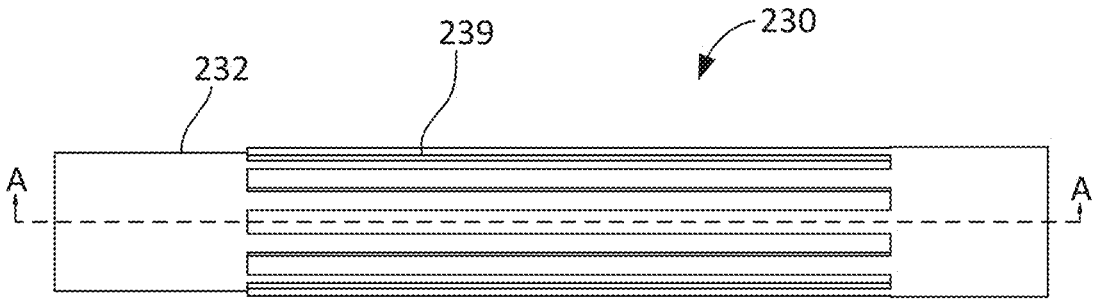
Figure 7C:
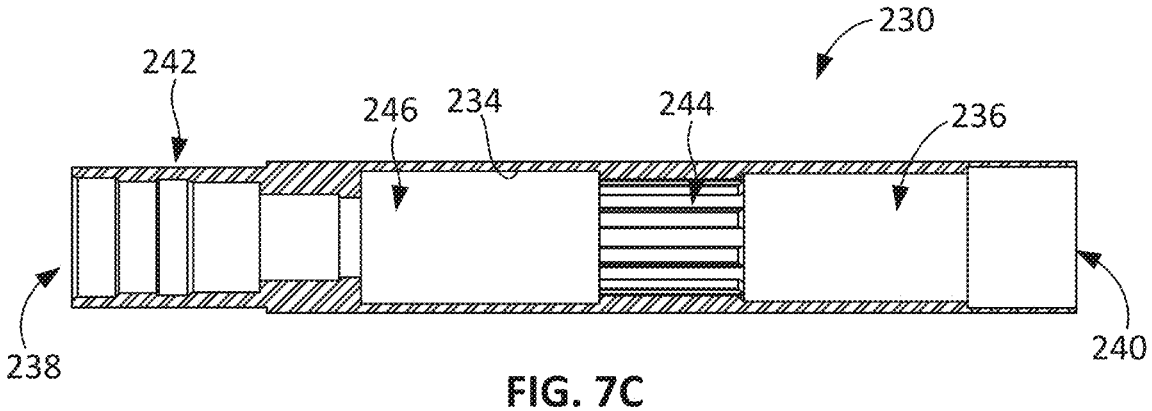
FIG. 7C is a cross-sectional view of the clutch shuttle taken along the line A-A in FIG. 7B.

The second coupling element of the clutch mechanism 206 in this example comprises a clutch shuttle 230 shown in FIGS. 7A to 7C that is movable to selectively engages the spline gear 226 of the driveshaft 202. FIGS. 7A and 7B are perspective and side views of the clutch shuttle 230. FIG. 7C is a cross-sectional view of the clutch shuttle 230 taken along the line A-A in FIG. 7B. The clutch shuttle 230 is a second coupling element of the clutch mechanism 206. As shown, the clutch shuttle 230 is approximately tubular in shape and has an outer surface 232 and an inner surface 234. The inner surface 234 defines a channel 236 extending axially through the clutch shuttle. The channel 236 is dimensioned to receive the mandrel portion 227 of the driveshaft 202 therethrough such that the spline gear 226 is positioned within the channel 236 and axially movable therein.

With reference to FIG. 7C, the shuttle has an upper end 238 and a lower end 240 with the channel 236 extending therebetween. The clutch shuttle 230 optionally has an upper connector portion 242 at the upper end 238 for coupling to a pushrod assembly 219 (shown in FIG. 9). The inner surface 234 of the channel 236 defines female inner splines 244. The female inner splines 244 are configured to engage the male splines 228 on the driveshaft 202 (shown in FIGS. 6A and 6B). The female inner splines 244 only extend partially along the axial length of the channel 236 providing sufficient clearance in a portion 246 of the channel 236 for the male splines 228 to travel uphole relative to, and disengage from, the female inner splines 244. A radial bearing (not shown) may optionally be positioned within the channel 236 around the driveshaft 202 to provide radial support for the clutch shuttle 230.

The clutch shuttle 230 may be rotationally locked with the housing 208 (shown in FIG. 5). As shown in FIGS. 7A and 7B, the clutch shuttle 230 comprises outer male splines 239 (defined by the outer surface 232).

Figure 8:
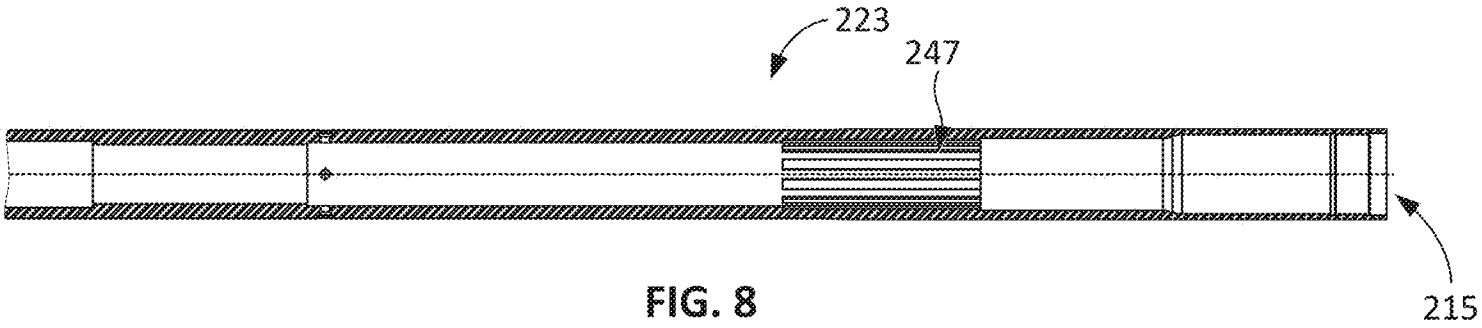
FIG. 8 is a side, cross-sectional, partial view of a lower housing section of the clutch assembly of FIG. 5 according to some embodiments.

FIG. 8 is a side, cross-sectional, partial view of the lower housing section 223, which includes inner female splines 247 that engage the outer male splines 239 of the clutch shuttle 230 to rotationally lock the clutch shuttle 230 and the lower housing section 223.

The clutch shuttle 230 is axially movable in the housing 208 by the pushrod assembly 219 (shown in FIG. 9). The clutch shuttle 230 is movable between an engaged configuration in which the clutch shuttle 230 engages the male splines 228 (shown in FIGS. 6A and 6B) such that the driveshaft 202 and housing 208 are rotationally coupled, and a disengaged position in which the clutch shuttle 230 is disengaged from the male splines 228 such that the driveshaft 202 is rotatable relative to the housing 208.

Embodiments are not limited to the particular clutch mechanism 206 shown in the drawings. In other embodiments, the clutch shuttle 230 of the clutch mechanism 206 may instead be connected to the driveshaft 202 and a male spline gear 228 may be provided on or connected to the pushrod assembly 219. Embodiments are also not limited to the spline gear/shuttle configuration of the clutch mechanism. Other forms of coupling elements suitable for a clutch mechanism in downhole applications may be used in other embodiments, such as dogs, or other structural features with interference fits to transfer rotation.

FIG. 9 is a perspective view of the pushrod assembly 219 of the assembly 200, with the clutch shuttle 230 of FIGS. 7A to 7C attached to the pushrod assembly 219. The pushrod assembly 219 in this embodiment comprises tubular pushrod 248, a coupling sleeve 250, a biasing mechanism 252, and a latch mechanism 254 (or "indexing mechanism"). The coupling sleeve 250 interconnects a lower end of the pushrod 248 and the connection portion 242 of the clutch shuttle 230 (shown in FIG. 8C). The actuation piston 220 (best shown in FIGS. 11A and 11B) is connected to an uphole end 237 of the pushrod 248 and is positioned within the upper housing section 221.

The actuation piston 220 and the pushrod 248 are axially shiftable together within the housing 208 in the uphole and downhole directions such that they can be moved between a first longitudinal position for a first (or 'normal') mode of operation, and a second longitudinal position for a second mode of operation. The first and second longitudinal position in this example is an uphole position corresponding to first mode of operation om which the clutch mechanism 206 is engaged. The second longitudinal position is a downhole position corresponding to second mode of operation in which the clutch mechanism 206 is engaged.

The biasing mechanism 252 is configured to exert a biasing force on the pushrod 248. The biasing mechanism 252 exerts a biasing force in the uphole direction in this example. The biasing mechanism 252 in this embodiment comprises a spring 256 disposed around the pushrod 248 and between upper collar 253*a* and lower collar 253*b*. The upper collar 253*a* is secured to the pushrod 248 and slidable within the housing 208, while the lower collar is axially fixed relative to the housing. The spring 256 may be pretensioned to provide upward (uphole) biasing force on the pushrod 248. In other embodiments, any other suitable type of biasing device capable of exerting a biasing force on the activation piston may be used.

The latch mechanism 254 and biasing mechanism 252 together may releasably hold the pushrod 248, the clutch shuttle 230, and the actuation piston 220 in each of the uphole positions and downhole positions, such that sufficient force is required to act on the actuation mechanism 212 to move the pushrod 248 between the uphole positions and downhole positions.

The latch mechanism 254 in this embodiment is a barrel cam assembly, similar to the barrel cam assembly described in Applicant's related U.S. Patent App. Pub. No. 2023/0295988, incorporated herein by reference. Non-limiting examples of alternative latch mechanisms include a linear actuator, a collet mechanism, and others.

Figure 14A:
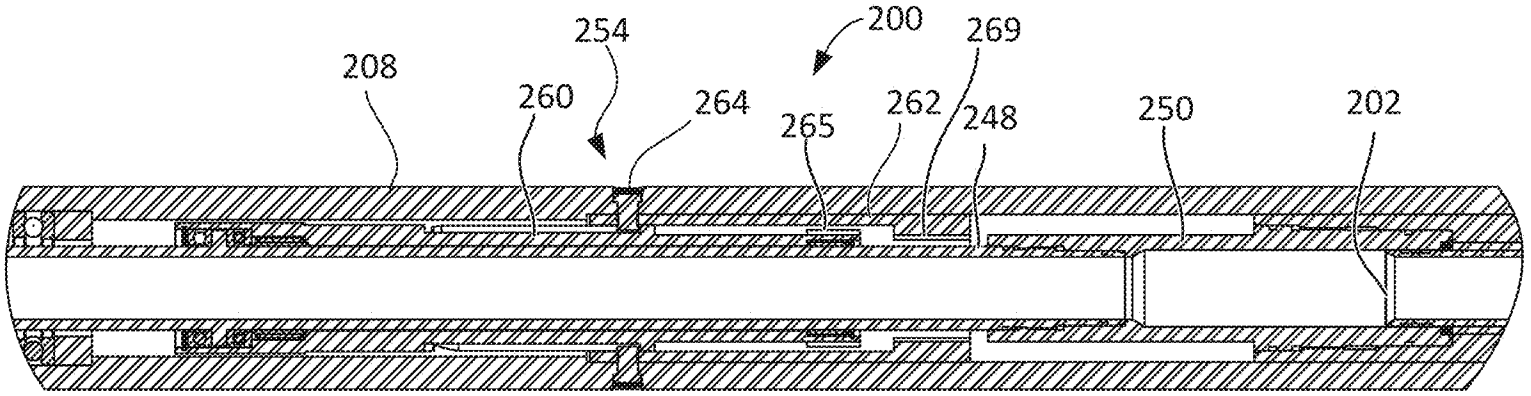
FIGS. 14A and 14B are partial side cross-sectional views of the assembly of FIG. 5 showing the latch mechanism with a pushrod in the uphole configuration and downhole configurations respectively.
Figure 14B:
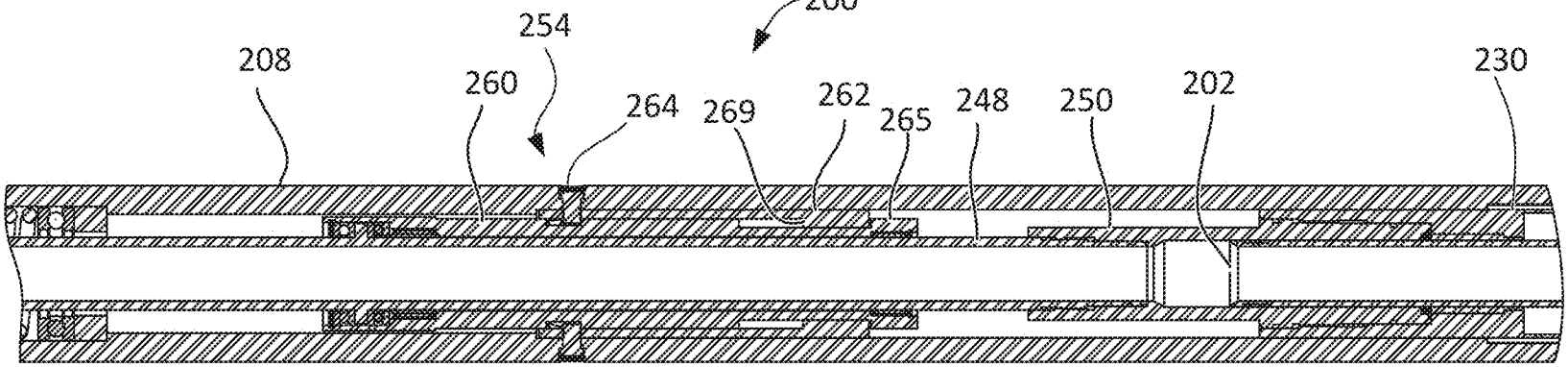

The latch mechanism 254 in this example is an indexing mechanism comprising a rotatable barrel cam 260 axially fixed to the driveshaft 202 and a collar 262 with cam pins 264. The collar may be fixedly secured to the housing 208. For example, cam pins 264 extend into holes in the housing 208, as shown in FIGS. 14A and 14B, to prevent axial and rotational movement of the collar 262 and the cam pins 264 relative to the housing. The collar 262 may alternatively be fixed with the housing 208 via any suitable method (e.g. bolts). Alternatively, the barrel cam 260 could be rotatably fixed to the driveshaft 202 and the collar 262 could be rotatable relative to the housing 208.

Figure 10:
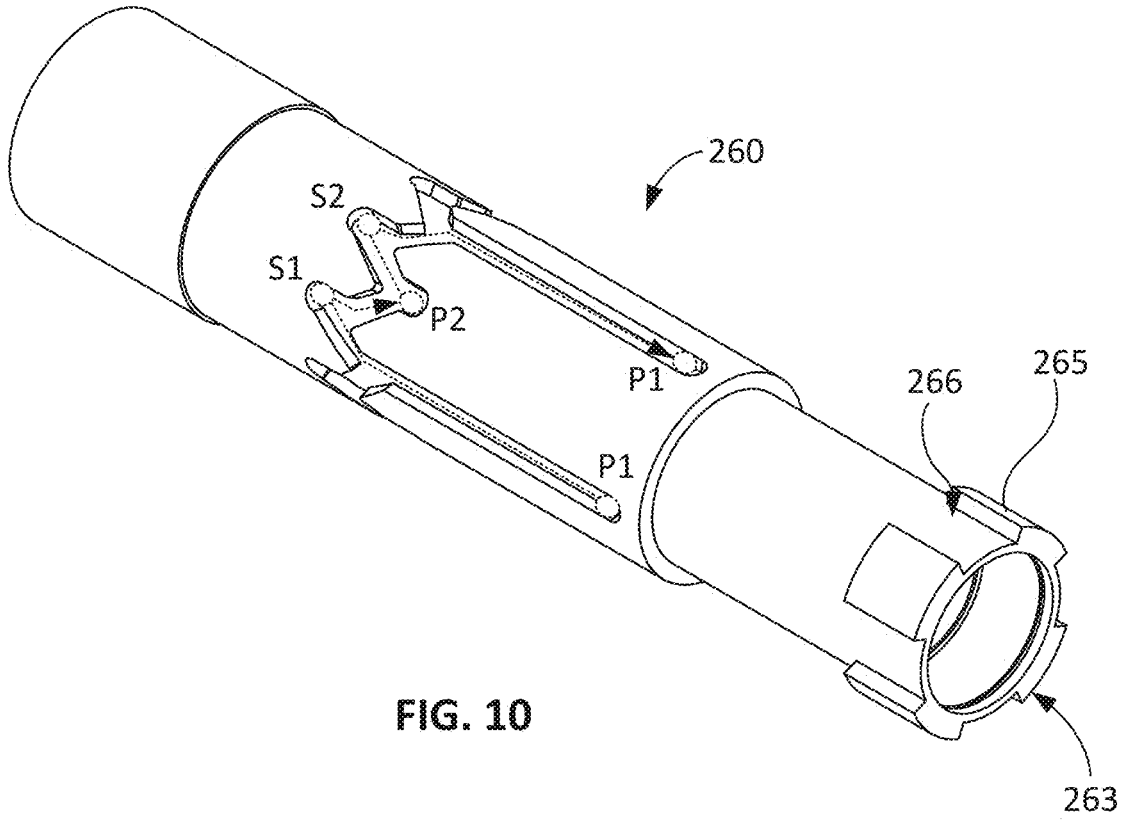
FIG. 10 is a perspective view of a cam barrel of a latch mechanism of the clutch assembly of FIG. 5 according to some embodiments.

FIG. 10 shows the barrel cam 260 in isolation. The barrel cam 260 in this embodiment defines a track 266 in its outer surface having first and second mode pin positions P1 and P2 (illustrated by stippled line circles) for the cam pins 264. The collar 262 may be rotatable relative to the housing to accommodate movement of the cam pins 264 through the track 266. The first mode pin position P1 corresponds to the uphole position (i.e. first longitudinal position) of the actuation mechanism 212, and the second mode pin position P2 corresponds to the downhole position (i.e. second longitudinal position) of the actuation mechanism 212. The track 266 interconnects a plurality of downhole stops at longitudinal position P1 and longitudinal position P2, spaced circumferentially about the barrel cam 260. Alternating downhole and uphole movement of the barrel cam 260 moves the cam pins 264 within the track 266 between the two pin positions P1 and P2 in an alternating fashion, as indicated by stippled arrows in FIG. 10.

As will be explained below, uphole and downhole shifting movement cycles the of the pushrod 248 and the actuation piston 220 between the uphole and downhole positions corresponding to the pin positions P1 and P2 in FIG. 10. Cycling the latch mechanism 254 includes downhole shifting the pushrod 248 beyond the eventual downhole position (corresponding to the second mode pin position P2) to a temporary "fully downhole shifted" position corresponding to pin stop positions S1 and S2 shown in FIG. 10. From position S1, uphole movement of the pushrod 248 causes the cam pins 264 to travel to the second mode pin position P2 (corresponding to the downhole position of the pushrod 248 and actuation piston 220). From position S2, uphole movement of the pushrod 248 causes the cam pins 264 to travel to the next first mode pin position P1 (corresponding to the uphole position of the pushrod 248 and actuation piston 220).

In normal operation, the cam pins 264 may each initially be positioned at a respective first mode pin position P1 for normal operation, the biasing force provided by the biasing mechanism 252 biases the pushrod 248 and barrel cam 260 in the uphole direction, such that the barrel cam 260 is releasable held with the cam pins 264 in the first mode pin position P1. As will be discussed below, this configuration of the pushrod 248 corresponds to the engaged configuration of the clutch mechanism 206 and the open configuration of the valve mechanism 210.

Sufficient downward actuation force on the pushrod 248 to overcome the biasing force moves the pushrod 248 and barrel cam 260 in the downhole direction until the cam pins 264 are stopped in first stop position S1. In this configuration, the pushrod 248 is in the "fully downhole shifted" position. The force required to overcome the biasing force of the biasing mechanism 252 may be referred to as the "activation threshold".

When the downhole actuation force is stopped or lowered below the "activation threshold", the upward biasing force will shift the pushrod 248 axially uphole a small distance until the cam pins 264 are stopped in the second mode pin position P2. The latch mechanism 254 stops further uphole movement from this position, and the biasing force provided by the biasing mechanism 252 now releasably holds with the cam pins 264 in the second mode pin position P2. Thus, the pushrod 248 is releasably held in the downhole position. In other words, the pushrod 248 is displaced in the downhole direction relative to when the cam pins 264 were in the first mode pin position P1. As will be discussed below, this downhole position of the pushrod 248 corresponds to the clutch-disengaged configuration and the valve mechanism closed configuration in this example.

To cycle the pushrod assembly 219 back to normal operation and engage the clutch mechanism, sufficient downward actuation force may again be applied to the pushrod 248 to satisfy the "activation threshold" and move the pushrod 248 and barrel cam 260 in the downhole direction until the cam pins 264 are stopped in second pin stop positions S2. When the downhole actuation force is stopped or lowered below the "activation threshold", the upward biasing force again shifts the pushrod 248 axially uphole until the cam pins 264 are in the next first mode pin position P1.

As noted above, the latch mechanism 254 stops uphole movement of the pushrod 248 from the downhole position (corresponding to pin positions P1 and P2). Various physical stop structures may be implemented to limit the axial movement of the pushrod 248 and actuation piston 220. The cam pins 264 and track 266 may be provide sufficient structural support to stop further downhole movement of the pushrod 248 when the cam pins 264 are in the stop positions S1 and S2. The cam pins 264 and track 266 may also provide sufficient structural support to stop uphole movement of the pushrod 248 when the pins are in the pin positions P1 and P2.

Optionally, the latch mechanism 254 may include additional structure for providing uphole and/or downhole stops. For example, in this embodiment, barrel cam 260 includes outer teeth 265 extending radially outward from its outer surface at its lower end 263, with axially aligned outer grooves 267 defined between the outer teeth 265. The inner surface of the collar 262 defines inner teeth 269 (visible in FIGS. 14A and 14B) and inner grooves (not shown) therebetween that are shaped complimentary to the outer grooves 267 and outer teeth 265 of the barrel cam 260 respectively. Referring to FIGS. 14A and 14B, the outer teeth 265 are positioned such that, during movement of the cam pins 264 from the first mode pin position P1 to the second stop position S2, the outer teeth 265 of the barrel cam 260 pass through the inner grooves between the inner teeth 269 of the collar 262. Rotation of the barrel cam 260 (due to travel of the cam pins 264 in the track 266) then rotates the outer teeth 265 to a position at least partially aligned with the inner teeth 269. As shown in FIG. 14B, in the downhole position (corresponding to second mode pin position P2 in FIG. 10), interference between the outer teeth 265 and inner teeth 269 stops uphole movement of the pushrod 248 and actuation piston 220. Cycling the latch mechanism 254 to move the pushrod 248 and actuation piston 220 back to the uphole position further rotates the barrel cam 260 and realigns the outer teeth 265 with the inner grooves of the collar 262, allowing the outer teeth 265 to move uphole through the grooves back to the longitudinal position shown in FIG. 14A.

Figure 11A:
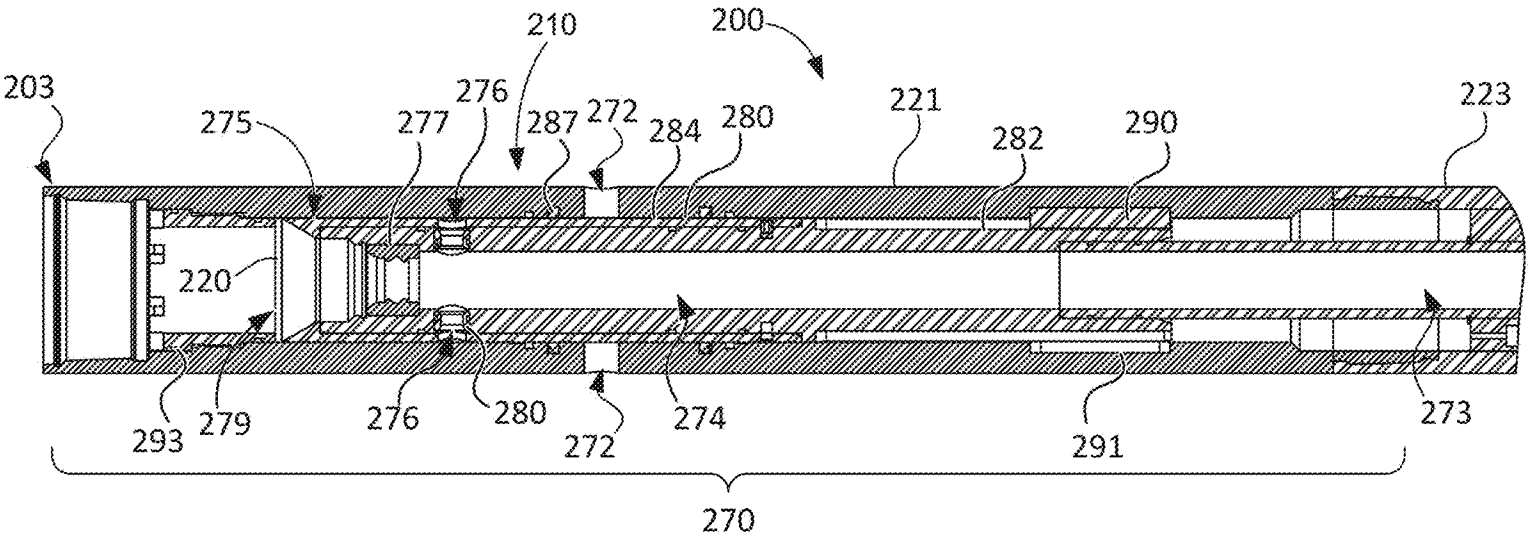
FIGS. 11A and 11B are partial side cross-sectional views, respectively, of the clutch assembly of FIG. 5 showing an actuation piston within an upper housing section according to some embodiments.
Figure 11B:
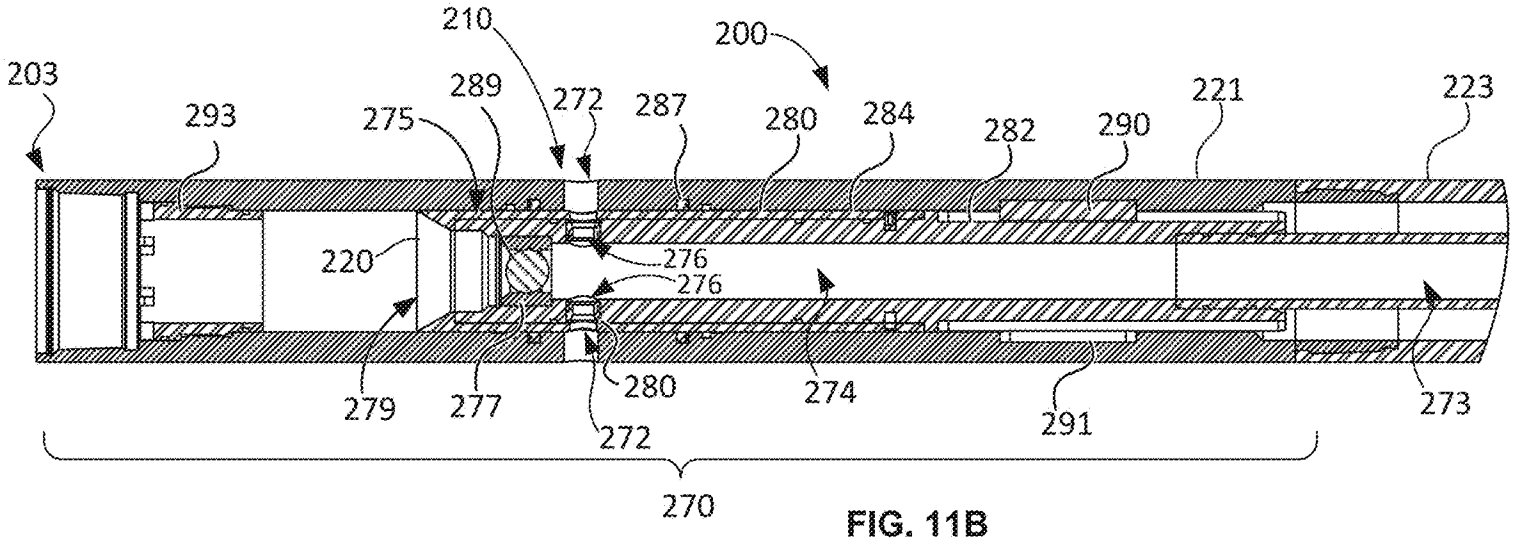

The assembly 200 may also include one or more additional structural features to act as a physical stop limiting movement of the pushrod 248 and actuation piston 220. For example, in this embodiment, a locknut 293 shown in FIGS. 11A and 11B is positioned within the upper housing section 221 uphole of the actuation piston 220 and stops upward movement of the actuation piston 220 from the uphole position. Embodiments are not limited to any particular method of limiting the uphole and downhole shifting movement of the pushrod 248 and actuation piston 220.

Turning again to FIG. 9, the pushrod assembly 219 may further include an oil compensator module 249 on the pushrod 248. Oil compensators are known in the art, and the example oil compensator 249 shown in FIG. 9 may compensate internal pressure within the housing 208 with the outside environment.

FIGS. 11A and 11B are partial side cross-sectional views of the assembly 200 showing actuation piston 220 within the upper housing section 221. The upper housing section 221 and the actuation piston 220 together form the valve mechanism 210 in this embodiment and may be referred to as a "circulation assembly" 270. However, embodiments are not limited to this configuration. The valve mechanism 210 may be implemented in other locations and/or by other equipment. Any suitable structure to selectively divert fluid into the annulus may be used. For example, a ball valve mechanism or other valve structure could be implemented in other embodiments. The location of the valve mechanism 210 may also vary.

The actuation piston 220 and pushrod 248 are axially movable within the housing 208 between the uphole position shown in FIG. 11A and the downhole position shown in FIG. 11B. The biasing mechanism 252 biases the pushrod 248 and actuation piston 220 toward the uphole position as explained above. The pushrod defines an axial passage (i.e. pushrod passage) therethrough, and the actuation piston 220 defines an axial passage 274 (i.e. piston passage) that extends therethrough. The axial bore 274 forms part of the fluid passage 207 though the assembly 200. The passage(s) 273 and 274 for fluid flow through the pushrod 248 and the actuation piston 220 may collectively be referred to as "an actuation member passage" herein and form part of the overall fluid passage 207 through the clutch assembly 200. As mentioned elsewhere, the actuation member(s) of the actuation mechanism 212 are not limited to the form of the pushrod 248 and actuation piston 220.

The diverter valve mechanism 210 in this embodiment is formed by the upper housing section 221 and the actuation piston 220. The diverter valve mechanism 210 comprises: one or more housing ports 272 extending through the upper housing section 221; and one or more piston ports 276 extending radially through the actuation piston 220. In this embodiment, the housing ports 272 are proximate the upper housing end 213 of the housing 208 and are spaced circumferentially therearound. The housing ports 272 may be in fluid communication with the annulus of the borehole. The piston ports 276 extend radially from the axial bore 274 to an outer surface 278 of the actuation piston 220. When the actuation piston 220 is in the uphole position (FIG. 11A), the housing ports 272 are not aligned with the piston ports 276, the valve mechanism is thus in its closed configuration and fluid is directed through the axial bore 274. When the actuation piston 220 is in the downhole position (FIG. 11B), the housing ports 272 are aligned with the piston ports 276 and some of the fluid flowing in the axial bore 274 is diverted into the annulus. That is, the valve mechanism 210 is in its open configuration, and fluid communication to the annulus is provided via the aligned housing ports 272 and piston ports 276.

The actuation piston 220 in this embodiment is pressure activated. More specifically, the actuation piston 220 comprises a plug catch portion 275 for receiving and landing a plug member therein to at least partially block flow through the bore 274. The plug member in this embodiment may be a ball, although other forms of plug members may be used in other embodiments. The catch portion 275 in this example comprises a ball seat 277 within the bore 274 near the upper end 279 of the actuation piston. The catch portion 275 may comprise a material that is does not substantially change properties based on temperatures in the downhole environment, such as a ceramic material for example. The plug catch portion (including the seat) may be implemented in the pushrod or other actuation member in other embodiments. Any suitable catch structure and positioning thereof for landing the plug member and blocking flow through the actuation member(s) such a pushrod and/or piston may be used. Some embodiments may not comprise a separate actuation piston, such as when the catch is integrated into the pushrod.

Blocking the downhole flow of fluid through the bore 274 (i.e. through the fluid passage 207 of the assembly) may generate a pressure differential. Pressure above the seat 277 member may increase relative to pressure below the seat 277. The pressure differential may provide a downward force on the actuation piston 220. When the pressure above the actuation piston exceeds the "activation threshold" the actuation piston 220 and pushrod 248 may move in the downhole direction.

The ball seat 277 may catch and hold a ball 289 dropped into the drill string from the surface, for example. The ball 289 is shown in FIG. 11B. The ball 289 and/or the ball seat 277 may be configured such that the ball 289 is released through the seat 277 when the pressure above the ball seat reaches a threshold. By way of example, 289 (or plug member with another shape) may be configured to deform at pre-determined threshold (e.g. 2000 psi), higher than the activation threshold, to allow the ball to pass through the seat 277. Alternatively, the ball seat 277 may be configured to deform at the pressure threshold. Thus, pressure building above the ball 289 may first move the actuation piston 220 to the downhole position of FIG. 11B, and then further increasing pressure may then release the ball 289. The ball 289 may then travel downhole through the fluid passage 207 and pass through the assembly 200. In some embodiments, the ball seat 277 may have a deformable structure, such as ridges that compress at the pre-determined pressure. The threshold for releasing the ball 289 form the seat 277 may be referred to herein as the "release threshold". The landing the ball 289 in the seat 277 may, thus, sequentially: (1) shift the actuation piston 220 and pushrod 248 in the downhole direction; and then (2) release the pressure differential such that the biasing force shifts the actuation piston 220 and pushrod 248 in the uphole direction. The ball may be made of a deformable material such as a plastic or elastomer material. The seat 277 may comprise a deformable material.

By positioning the ball seat 277 uphole of the ports 272/276 of the diverter valve mechanism 210, flow through the fluid passage 207 may be completely blocked while the ball (or other plug member) is in the seat 277 with no fluid through the upper subassembly 204 being diverted to the annulas even when the ports 272/276 become aligned during movement of the pushrod 248 and actuation piston 220. This blockage may facilitate building sufficient pressure to pressure-release the plug.

Figure 11C:
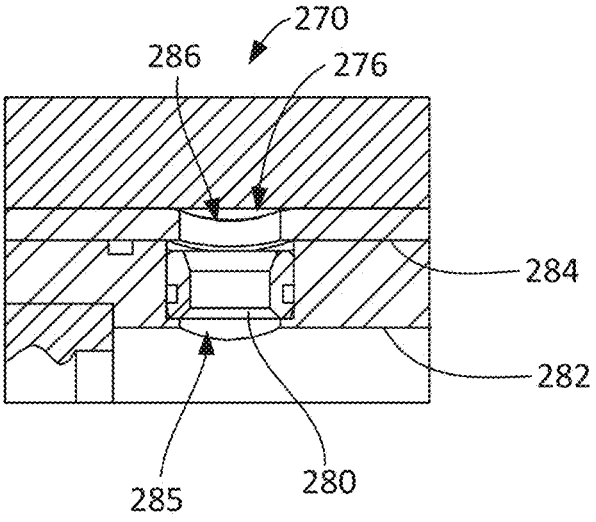
FIG. 11C is an enlarged partial view of the actuation piston and upper housing section of FIG. 11A.

The actuation piston 220 in this embodiment comprises a main body sleeve 282 within and abutting the upper housing section 221, and an outer sleeve 284 disposed around at least a portion of the actuation piston 220 between the actuation piston 220 and the upper housing section 221. The piston ports 276 extend through the main body sleeve 282 and the outer sleeve 284 in this embodiment. FIG. 11C is an enlarged partial view of the circulation assembly 270 showing one of the piston ports 276. Each piston port 276 includes a hole 285 through the main body sleeve 282 and a hole or aperture 286 through the outer sleeve 284 that is aligned with the hole 285 in the main body sleeve 282.

Nozzles 280 are received in the holes 285 of the main body sleeve 282. The apertures 286 in the outer sleeve 284 may have an inner diameter that is less than that of the holes in the main body sleeve 282, such that the outer sleeve 284 retains the nozzles 280 within the ports 276. The inner diameter of the nozzles 280 (e.g. orifices) may be selected based on the desired volume of fluid to be diverted out of the circulation assembly 270 into the annulus. In some embodiments, the nozzles 280 are replaceable such that the size of the nozzles 280 may be varied to vary the diverted fluid volume as desired.

The circulation assembly 270 may include one or more annular seals 287 between the actuation piston 220 and the upper housing section 221 to prevent fluid from leaking out of the housing ports 272 when the actuation mechanism 212 is in the uphole position (i.e. valve mechanism 210 is closed).

The actuation piston 220 may be rotationally locked with the upper housing section 221 to facilitate proper alignment of the housing ports 272 and the piston ports 276. For example, the actuation piston 220 may further comprises one or more keys 290 on its outer surface and the upper housing section 221 may further comprises one or more corresponding keyway slots 291. Each keyway slot 291 may receive one of the keys 290 therein to prevent rotation of the actuation piston 220, while still allowing the actuation piston 220 to move axially. In some embodiments, a spacing structure (e.g. locknut 292) may also provided within the upper housing section 221 uphole of the actuation piston 220 to limit uphole movement of the actuation piston 220 and/or preload the biasing mechanism 252.

Figure 12A:
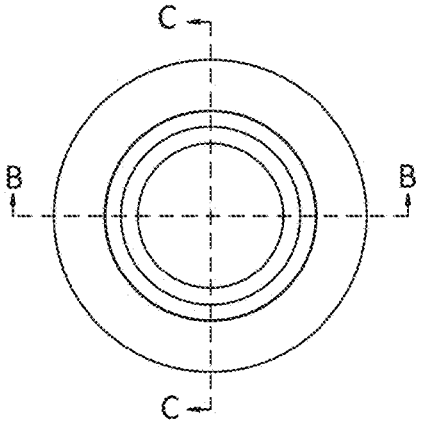
FIG. 12A is an end view of the actuation piston in isolation with a ball seat removed.
Figure 12B:
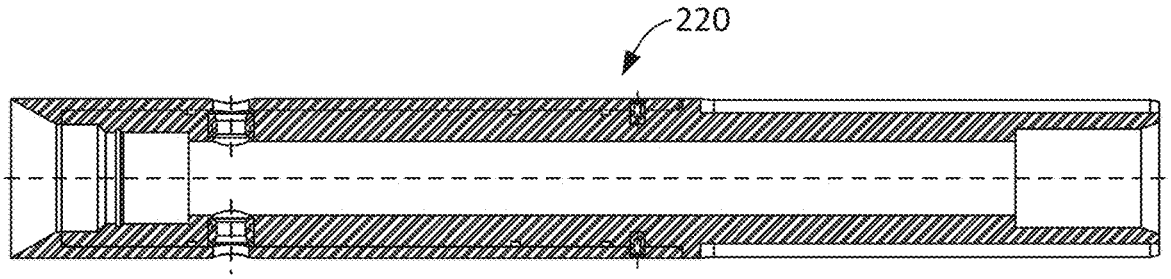
FIG. 12B is a cross-sectional view of the actuation piston (with the ball seat removed) taken along line B-B in FIG. 12A.
Figure 12C:
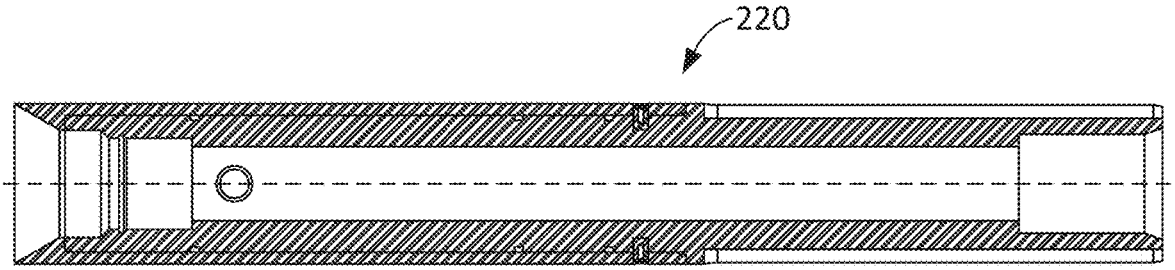
FIG. 12C is a cross-sectional view of the actuation piston (with the ball seat removed) taken along line C-C in FIG. 12A.

FIG. 12A is an end view of the actuation piston 220 in isolation with the ball seat 277 removed. FIG. 12B is a cross-sectional view of the actuation piston 220 (with the ball seat 277 removed) taken along line B-B in FIG. 12A. FIG. 12C is a cross-sectional view of the actuation piston 220 (with the ball seat 277 removed) taken along line C-C in FIG. 12A.

Figure 13A:
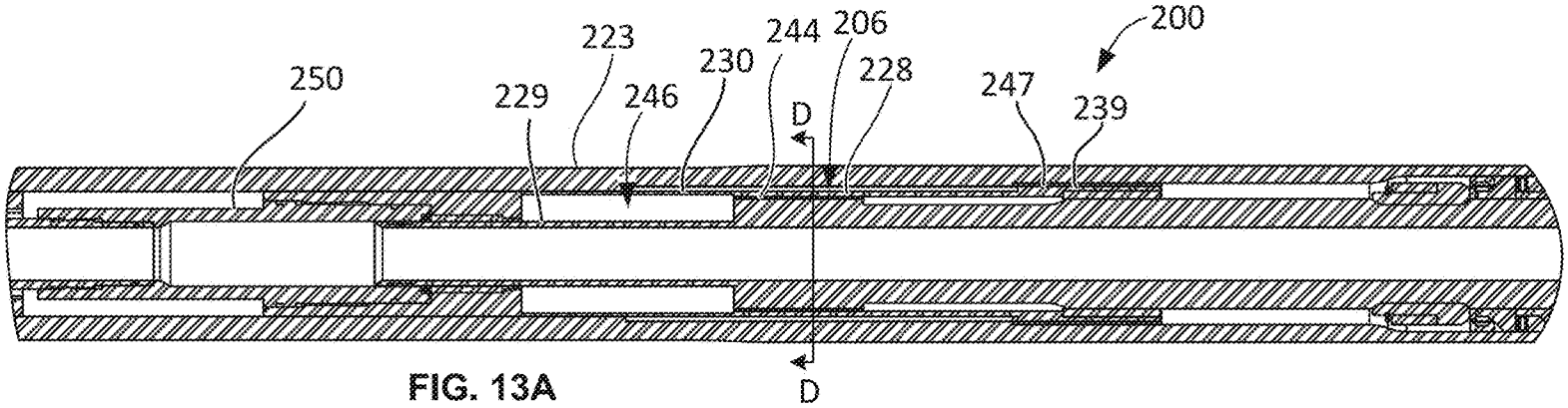
FIGS. 13A and 13B are partial side cross-sectional views of the assembly of FIG. 5 showing a clutch mechanism in engaged and disengaged configurations respectively.
Figure 13B:
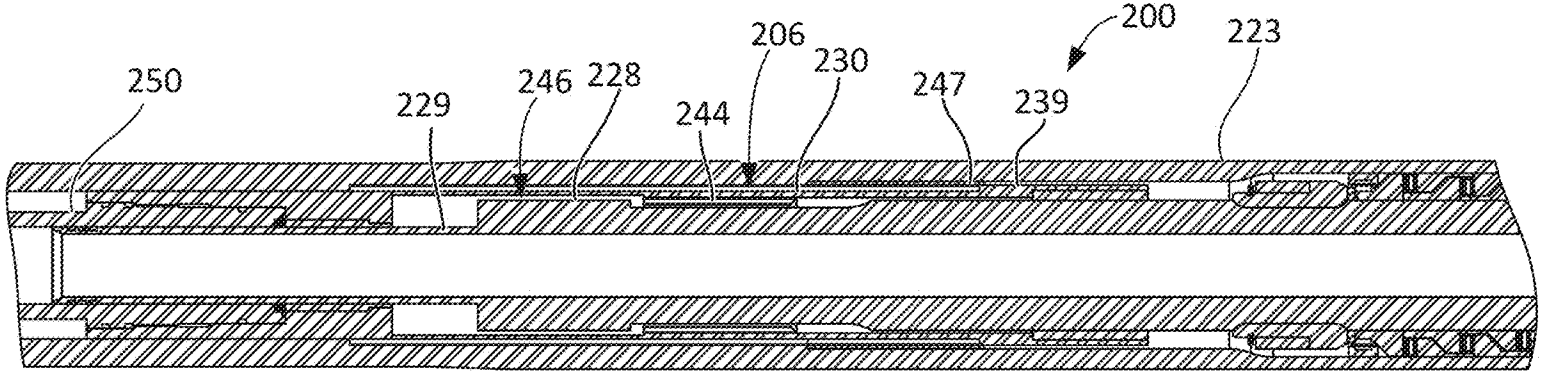

FIGS. 13A and 13B are partial side cross-sectional views of the assembly 200 showing the clutch mechanism 206 in the engaged and disengaged configurations respectively. In FIG. 13A, the pushrod assembly 219 is in the uphole position for normal operation. The female inner splines 244 of the clutch shuttle 230 are positioned such that they are engaged with the male splines 228 of the driveshaft 202. The top portion 229 of the driveshaft 202 is slidingly and sealingly received within the coupling sleeve 250 of the pushrod assembly. When the actuation piston 220 (shown in FIGS. 11A to 12C) and pushrod 248 are moved to the downhole position, the clutch shuttle 230 is moved downhole to the position shown in FIG. 13B. In the position shown in FIG. 13B, the female inner splines 244 of the clutch shuttle 230 axially displaced and disengaged from the male splines 228 of the driveshaft 202, and the male splines 228 are located in the clearance portion 246 of the clutch shuttle 230. FIGS. 13A and 13B also show the male splines 239 of the clutch shuttle engaged with the inner splines 247 of the lower housing section 223.

Figure 13C:
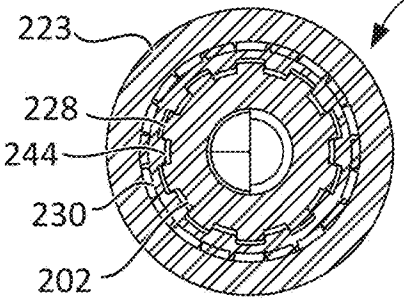
FIG. 13C is a cross-sectional view taken along the line D-D in FIG. 13A.

FIG. 13C is a cross-sectional view of the assembly 200 taken along the line D-D in FIG. 13A. FIG. 13C, shows the driveshaft 202 with male splines 228 engaged with the female inner splines 244 of the clutch shuttle.

FIGS. 14A and 14B are partial side cross-sectional views of the assembly 200 showing the latch mechanism 254 with pushrod 248 in the uphole configuration and downhole configurations respectively. Thus, in FIG. 14A, the cam pins 264 are in the first mode pin position P1 shown in FIG. 10. In FIG. 14B, the cam pins 264 are in the second mode pin position P2 shown in FIG. 10.

Figure 15:
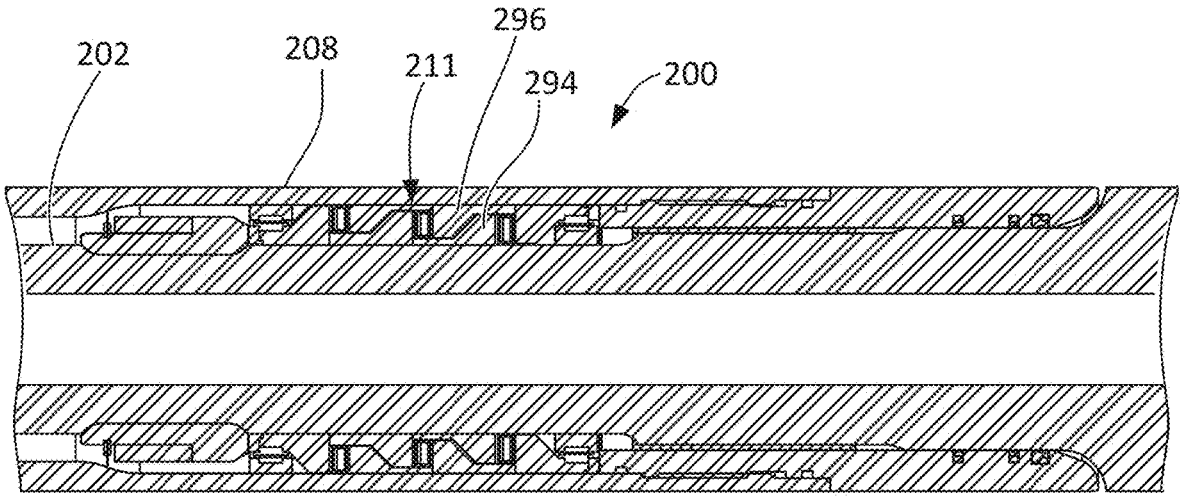
FIG. 15 is a partial side cross-sectional view of the assembly of FIG. 5 showing a one-way bearing assembly according to some embodiments.

FIG. 15 is a partial side cross-sectional view of the assembly 200 showing the one-way bearing assembly 211 of this embodiment. The one-way bearing assembly 211 may comprise one or more inner collar 294 secured around the mandrel portion 227 of the driveshaft 202, and one or more outer collar 296 secured to the inner surface of the housing 208 (within the housing bore). Bearing members (e.g. ball bearings) may be positioned between the collars 294 and 296 and the collars 294 and 296 and/or other internal features (e.g. springs) within the bearing assembly 211 may be configured to allow the inner collar(s) 294 to rotate in the drilling (forward) direction relative to the outer collar(s) 296, but not in the opposite (reverse) direction. Any suitable one-way bearing assembly may be used. As discussed above, the one-way bearing may prevent backspin when the clutch mechanism 206 is disengaged, while still allowing rotation of the uphole portion of the drill string relative to the downhole portion of the drill string. Embodiments are not limited to the particular example one-way bearing assembly 211 shown in FIG. 15.

Example operation of the assembly 200 described above with reference to FIGS. 5 to 15 will now be described.

During a drilling operation, for example, the assembly 200 may be connected between an uphole drill string section (connected to the upper subassembly 204) and a downhole drill string section such as the BHA 31 described above (connected to the driveshaft 202). The downhole drill string section may, for example, include a mud motor, drill bit, and/or equipment. Embodiments are not limited to this particular example implementation.

For normal drilling operation, the clutch mechanism 206 may be engaged. That is, the pushrod 248 and the actuation piston 220 may be in the uphole position (i.e. first longitudinal position) such that the clutch mechanism 206 is in the engaged configuration shown in FIG. 13A. In this configuration, the cam pins 264 (FIGS. 7, 14A and 14B) are each in the pin position P1 shown in FIG. 10.

When it is desired to disengage the clutch mechanism, a ball (or other plug member) may be dropped through the drill string, and the ball may become landed on the ball seat 277 of the actuation piston 220 (see FIGS. 11A and 11B), thereby blocking flow through the fluid passage 207 and building pressure above the ball. When pressure passes a first pressure threshold to overcome the biasing force of the biasing mechanism 252, the actuation piston 220 and pushrod 248 are moved downhole, thereby disengaging the clutch mechanism 206. More specifically, the inner splines 244 of the clutch shuttle 230 disengage the male splines 228 on the driveshaft 202. The driveshaft 202 may thus rotate relative to the housing 208. The one-way bearing assembly 211 may prevent backspin by restricting rotation of the driveshaft 202 to the forward (i.e. drilling) direction.

Downward movement of the actuation piston 220 and pushrod 248 may continue until the cam pins 264 are in the first stop pin position S1 relative to the barrel cam 260 (see FIG. 10). This movement partially rotates the barrel cam 260 as the cam pins 264 travel in the track 266.

Pressure above the ball may continue to increase until it passes the "release threshold" and the ball passes through the seat 277 as discussed above. Fluid flow may again be provided through the assembly 200 and pressure in the fluid passage 207 may equalize. When pressure above the actuation piston 220 drops, the biasing device 252 may move the pushrod and actuation piston 220 uphole to move the cam pins 264 to the second mode pin position P2 (FIG. 10). This movement further rotates the barrel cam 260 as the cam pins 264 continue to travel in the track 266

In this position, the piston ports 276 and housing ports 272 of the valve mechanism 210 are aligned, and at least some fluid flowing in the fluid passage 207 may be diverted to the annulus. This diversion of fluid may deactivate or partially deactivate equipment downhole of the assembly 200, such as the mud motor or drill bit.

The latch mechanism 254 may releasable hold the actuation mechanism 212 in the downhole position (i.e. second longitudinal position) with the clutch mechanism 206 disengaged and the valve mechanism 210 in the opened configuration. The ball may travel through the fluid passage 207 and exit the downhole end 205 of the assembly 200.

When it is desired to re-activate the clutch mechanism 206, a further ball (or other plug member) may be dropped through the drill string, and the further ball may become landed on the ball seat 277 of the actuation piston 220 (see FIGS. 11A and 11B), thereby blocking flow through the fluid passage 207 and building pressure above the ball. When the pressure above the seat 277 passes the "activation threshold" and overcomes the biasing force of the biasing mechanism 252, the actuation piston 220 and pushrod 248 are again moved downhole until the cam pins 264 are in the second uphole stop position S2 relative to the barrel cam 260 (see FIG. 10). This movement further rotates the barrel cam 260 as the cam pins 264 continue to travel in the track 266 Pressure above the ball may continue to increase until the "release threshold" is met and the ball passes through the seat 277. Fluid flow may again be provided through the assembly 200 and pressure in the fluid passage 207 may equalize. When pressure above the actuation piston 220 drops, the biasing device 252 may move the pushrod and actuation piston 220 uphole to move the cam pins 264 to the second mode pin position P2 (FIG. 10). The pushrod 248, thus, is moved to re-engage the inner splines 244 of the clutch shuttle 230 with the splines 228 on the driveshaft 202, the clutch mechanism is re-engaged. Additionally, the piston ports 276 and housing ports 272 of the valve mechanism 210 are no longer aligned and fluid is no longer diverted to the annulus. Thus, the valve mechanism 210 is in the closed configuration, and full fluid flow through the fluid passage 207 to downhole equipment (such as the mud motor and drill bit) may again be provided. The latch mechanism 254 may releasable hold the actuation mechanism 212 in this configuration until another ball is dropped into the assembly 200. The assembly 200 may be repeatedly cycled between these configurations by successive ball drops.

Various modifications may be made to the assembly 200. For example, the valve mechanism 210 may be implemented in or proximal to the clutch shuttle, for example. In still other embodiments, the actuation mechanism 212 and valve mechanism 210 may be implemented downhole of the clutch mechanism 206 (i.e. in a downhole assembly portion). The relative positions of the driveshaft 202 and components of the upper subassembly 204 may also be switched in some embodiments, such that a lower assembly includes an actuation mechanism, clutch mechanism, and/or valve mechanism, and a similar driveshaft is uphole of the clutch mechanism. Other variations are also possible.

Figure 16:
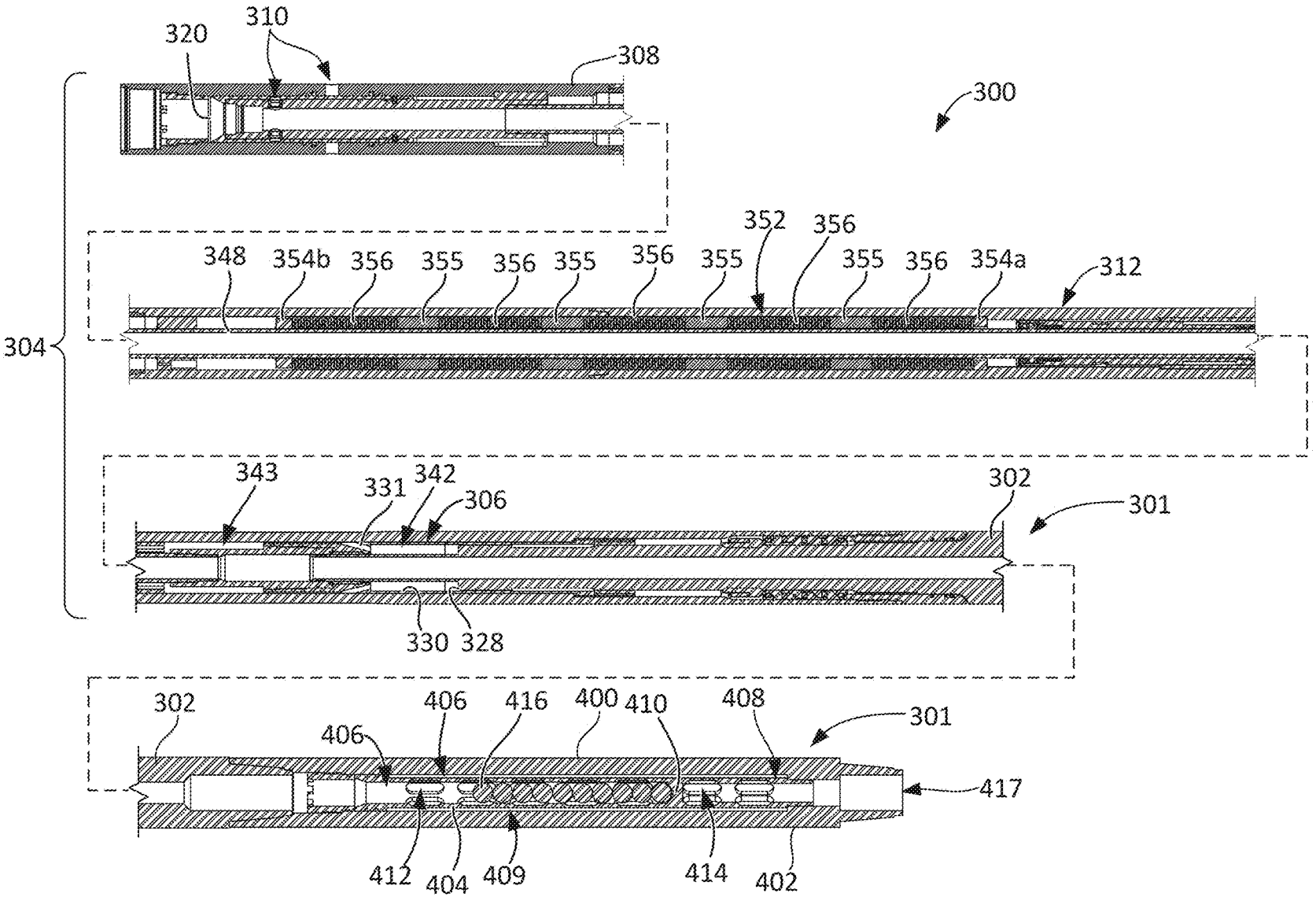
FIG. 16 is a side cross-sectional view of another example clutch assembly according to some embodiments.

FIG. 16 is a side cross-sectional view of another example assembly 300 according to some embodiments. The assembly 300 includes a lower assembly 301 (or "lower assembly portion"), an upper subassembly 304 (or "upper assembly portion") and a releasable clutch mechanism 306 that selectively rotationally couples the upper subassembly 304 with the lower assembly 301. The upper assembly portion 304 is similar to the upper subassembly 204 described above and shown in FIG. 5. More particularly, the upper subassembly 204 comprises a housing 308, a diverter valve mechanism 310 and an actuation mechanism 312. The clutch mechanism 306 includes a clutch shuttle 330 (of the upper subassembly 304) and a spline teeth 328 on the driveshaft 302. These components of the upper subassembly 304 and driveshaft 302 are similar in structure and function to the example clutch assembly 200 in FIG. 5 and described above, with some differences discussed below.

A biasing mechanism 352 in this example includes a plurality of disc springs 356 arranged in series between a lower stop ring 354*a* and an upper stop ring 354*b*. The upper stop ring 354*b* may be fixed to pushrod 348 and the lower stop ring 354*b* may be slidable relative to the pushrod 348 and axially fixed relative to the housing 308. Thus, downhole movement of the pushrod 348 compresses the disc springs 356. Slidable spacer rings 355 are positioned between adjacent pairs of disc springs 356.

The annular regions between the housing 308 and the pushrod 348 and other components within the housing 308 may be filled with fluid such as oil. In this example embodiment, the clutch shuttle 330 defines ports 331 and grooves 332 that provide fluid communication for flow of fluid (e.g. oil) between the interior 342 of the clutch shuttle 330 and an annular region 343 uphole of the clutch shuttle interior 342 as the clutch shuttle 330 is shifted uphole or downhole.

The lower assembly portion 301 in this example includes a driveshaft 302 that is similar in structure and function to the driveshaft 202 of the assembly 200 in FIG. 5. The lower assembly portion 301 in FIG. 14, however, further includes a ball catch unit 400 is connected to the downhole end of the driveshaft 302. The ball catch unit 400 may be connectable to downhole equipment such as a downhole drill string section.

The ball catch unit 400 comprises an outer catch housing 402 and an inner tubular member 404. The inner tubular member 404 includes an upper tubular portion 406 and a lower tubular portion 408, and a ball stop 410 between the upper and lower tubular portions 406 and 408. The ball catch unit 400 further includes an annular fluid passage 409 between the outer catch housing 402 and the inner tubular member 404. A plurality of upper tubular section ports 412 and a plurality of lower tubular section ports 414 extend radially through the inner tubular member 404. Fluid may, thus, flow from the upper tubular portion 406 to the lower tubular portion 408 via the ports 412 and 414 and the annular fluid passage 329. Balls 416 or other plug members successively released from actuation piston 320 may travel through the fluid passage 407 through the assembly 300 and be collected in the ball catch unit 400. The balls or other plug members are stopped from progressing out of the assembly 300 by the ball stop 410, while fluid may continue through (via the ports 412 and 414 and the annular fluid passage 329) and exit the assembly 300 through a downhole end 417 of the ball catch unit 400, which may be referred to as "ball catch sub".

Operation of the assembly 300 may be similar to operation of the assembly 200 of FIG. 5, but with balls successively captured within the ball catch unit 400 after they each ball is released from the actuation piston 320.

In the examples described above, the actuation mechanism (212, 312) and diverter valve mechanism (210, 310) are positioned in the upper subassembly (204, 304). However, it will be appreciated that one or more of these (or components thereof) may instead be part of a lower subassembly below the clutch mechanism (206, 306). For example, at least one actuation member (e.g., similar to pushrod 248 and/or actuation piston 220) may be located below the clutch mechanism to move a clutch shuttle or other clutch component into and out of engagement and/or to open or close a valve mechanism. A ball or other plug may be landed in a seat coupled to the at least one actuation member below the clutch mechanism to shift the actuation member downhole and disengage the clutch mechanism for example. Other variations are also possible.

Figure 17:
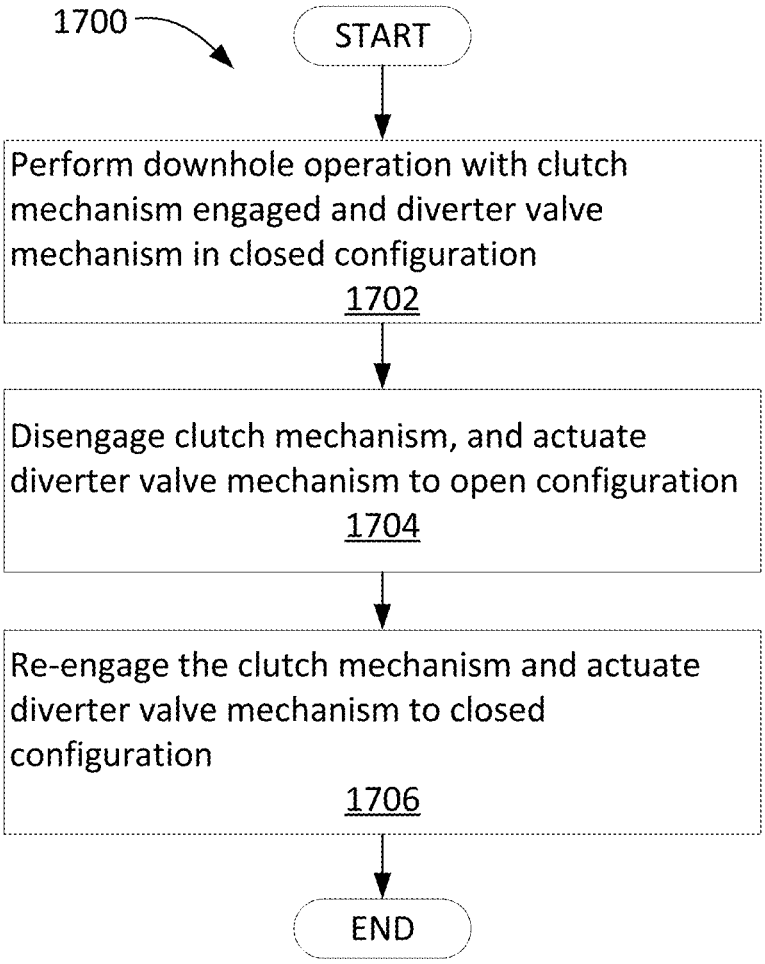
FIG. 17 is a flowchart of an example method according to some embodiments.

FIG. 17 is a flowchart of a method 1700 according to some embodiments. The method may be performed using the assembly 200 described with reference to FIGS. 4 to 15 or the assembly 300 described with reference to FIG. 16, for example. The method is not limited to these specific example assembly embodiments. The assembly may be connected between upper and lower drill string sections.

At block 1702, a downhole operation is performed with the clutch mechanism (206, 306) engaged and, if a diverter valve mechanism is included, the diverter valve mechanism (210, 310) in the closed configuration. The downhole operation may, for example, be a drilling operation in which drilling fluid is pumped downhole through the drill string. The drilling fluid may pass through the fluid passage (207, 307) through the assembly (200, 300).

At block 1704, the clutch mechanism (206, 306) is dis-engaged and optionally the diverter valve mechanism is actuated to the open configuration. The one-way bearing assembly (211, 311) may prevent backspin when the clutch mechanism is disengaged as described above.

Disengaging the clutch mechanism may comprise landing a plug member on a seat of the actuation piston, as described above, thereby blocking fluid flow through the fluid passage and causing pressure above the seat to meet a first pressure threshold. Disengaging the clutch mechanism may further comprise releasing the ball from the seat when the pressure meets a second pressure threshold higher than the first pressure threshold, thereby resuming the fluid flow through the fluid passage.

At block 1706, the clutch mechanism may optionally be re-engaged, and optionally the diverter valve mechanism may optionally be actuated to the closed configuration, for resuming the downhole operation. Re-engaging the clutch mechanism may comprise landing another plug member in the seat. Re-engaging the clutch mechanism may further comprise releasing the other plug member from the seat.

Cycling the clutch mechanism and/or diverter valve mechanism may comprise successively landing one or more plug members as in blocks 1704 and 1706 in the example method 1700 described above.

Figure 18:
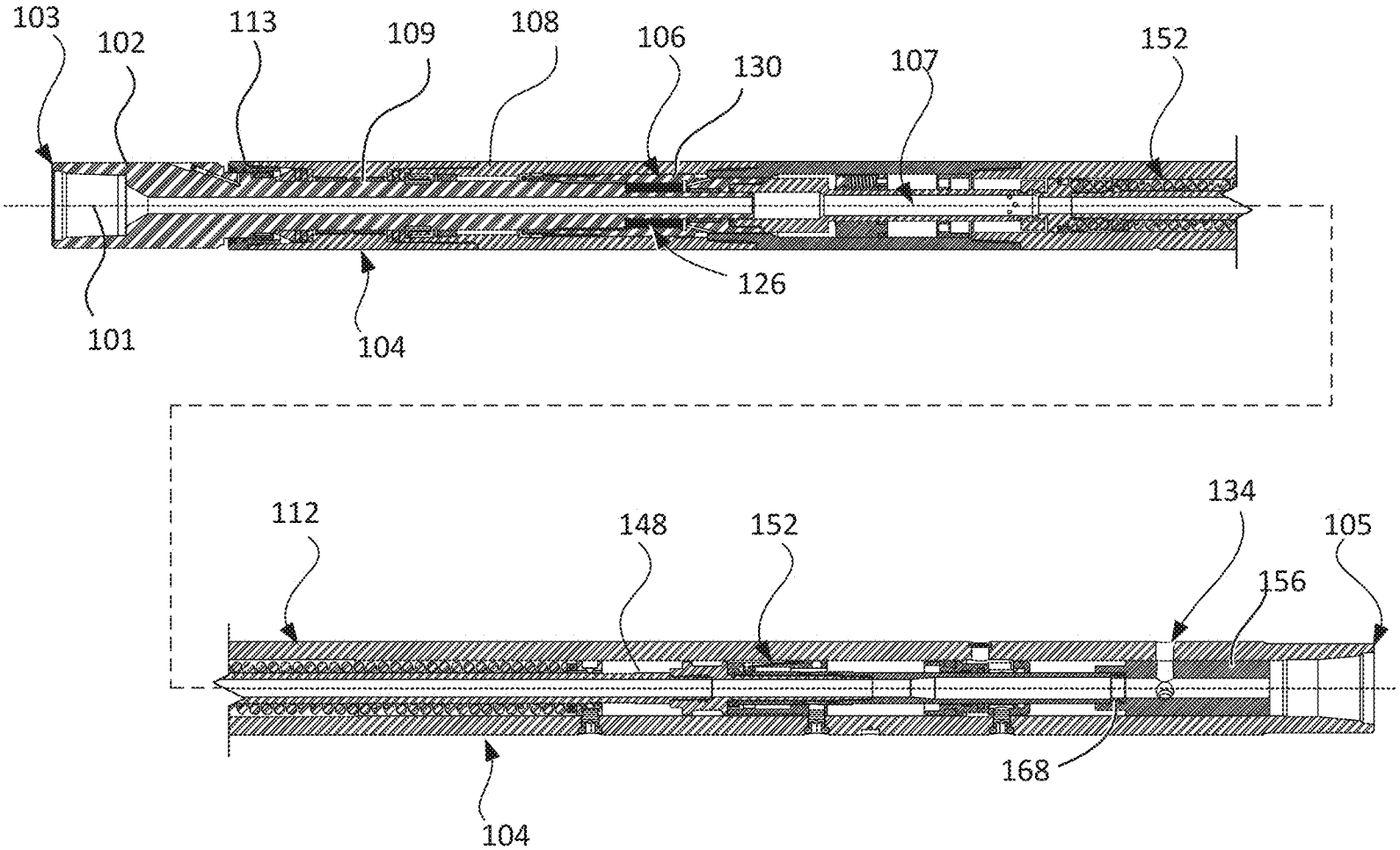
FIG. 18 is a side, cross-sectional view of the clutch assembly of the example drill string of FIG. 3.

FIG. 18 is a side cross-sectional view of an example implementation of the clutch assembly 100 of FIG. 3. The system 100 has an uphole end 103, a downhole end 105, and a longitudinal axis 101. As used herein, the terms "axial" and "longitudinal" are intended to refer to the approximate direction of the longitudinal axis 101. The clutch assembly 100 comprises the upper assembly portion 102, the lower assembly portion 104, and the clutch mechanism 106. The upper assembly portion 102 in this example is a driveshaft 102, and the lower assembly portion 104 will be referred to as the lower subassembly 104. The lower assembly portion 104 comprises a housing 108 that partially receives the driveshaft 102 therein. More specifically, a mandrel portion 109 of the driveshaft 102 is received in the housing 108 (through an upper end 113 of the housing 108). The lower assembly portion 104 further comprises a diverter valve mechanism 110 and an actuation mechanism 112 within the housing 108. An axial passage 107 extends through the clutch assembly 100 along the longitudinal axis 101 from the uphole end 103 to the downhole end 105 to allow drilling fluid to flow through the clutch assembly 100 to an RSS and drill bit.

The clutch mechanism 106 has an engaged configuration and a disengaged configuration, similar to the clutch mechanisms described above. In this example, the clutch shuttle 130 is part of the lower subassembly 104, and the driveshaft 102 comprises a spline gear 126. The clutch shuttle 130 is axially movable between engaged and disengaged positions.

The actuation mechanism 112 comprises a tubular rod assembly 148 (i.e. actuation member(s)) biased in the uphole direction by a spring device 152. The actuation mechanism also includes an indexing-type latch mechanism 154 for releasably holding the actuation mechanism 112 in uphole and downhole positions, similar to the actuation mechanism 212 of the clutch assembly 200 described above and shown in FIG. 5. However, in this example, the actuation mechanism 112 is part of the lower subassembly 104 below the clutch mechanism 106. The actuation mechanism 112 further comprises a pressure differential mechanism 168, which is a flow restrictor in this example. Flow within the passage 107 creates pressure above the flow restrictor 168, which may overcome the upward biasing force and shift the tubular rod assembly 148 and other components of the actuation mechanism 212 in the downhole direction. Reducing flow may then reduce the pressure differential such that the upward biasing force shifts the actuation mechanism in the uphole direction. By this shifting movement, the latch mechanism 154 and the tubular rod assembly 148 may be cycled between the uphole and downhole positions.

The diverter valve mechanism 110 is below the actuation mechanism 112 in this embodiment. The diverter valve mechanism 110 comprises a tubular circulation piston 156 within the housing 108. The circulation piston 156 is connected to the tubular rod assembly 148 and is axially movable therewith. The piston 156 defines piston ports 132 extending radially therethrough, and the housing 108 defines housing ports 134 radially therethrough. When the tubular rod assembly 148 and circulation piston 156 are in the uphole position (for normal operation with the clutch mechanism 106 engaged), the ports 132/134 are not aligned and fluid is not diverted to the annulus. When the tubular rod assembly 148 and circulation piston 156 are in the downhole position (i.e. the clutch mechanism 106 is disengaged), the ports 132/134 are aligned and some fluid is diverted to the annulus.

Additional details and operation of the clutch assembly 100 in FIG. 18 is described in Applicant's U.S. Patent App. Pub. 2023/0295988.

The clutch assembly 100 in FIG. 18 may be modified according to the principles and aspects disclosed herein. For example, the clutch assembly 100 may optionally further include a one-way bearing arranged between the housing 108 and the driveshaft 102 (similar to the one-way bearing assembly 211 in FIG. 15) that restricts rotation of the lower subassembly in the drilling direction when the clutch is disengaged. As another example, rather than a flow restrictor to build a pressure differential, the clutch assembly 100 may include a plug seat configured to catch and releasably retain a plug for down-shifting the tubular rod assembly 148. The seat may be a ball seat similar to the example seat 277 in FIGS. 11A and 11B, but positioned in the passage 107 below the clutch mechanism 106. A plug landed on the seat may build pressure to overcome the upward biasing force at a first pressure threshold. The seat or the plug may be deformable so that the plug is released from the seat at a second pressure threshold higher than the first pressure threshold. Other variations and modifications are also possible.

Although particular embodiments have been shown and described, it will be appreciated by those skilled in the art that various changes and modifications might be made without departing from the scope of the disclosure. The terms and expressions used in the preceding specification have been used herein as terms of description and not of limitation, and there is no intention in the use of such terms and expressions of excluding equivalents of the features shown and described or portions thereof. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A clutch assembly for use in a wellbore and connectable between a first drill string section and a second drill string section, the clutch assembly comprising:

a first assembly portion connectable to the first drill string section;

a second assembly portion connectable to the second drill string section and comprising a driveshaft, the first assembly portion and the second assembly portion collectively defining a fluid passage therethrough from a first end of the clutch assembly to a second end of the clutch assembly;

a releasable clutch mechanism that selectively rotationally locks the first assembly portion with the second assembly portion, the first assembly portion comprising a first coupling element of the clutch mechanism, and the second assembly portion comprising a second coupling element of the clutch mechanism, the second coupling element being selectively engageable with the first coupling element;

a one-way bearing assembly allowing rotation of the driveshaft relative to the first assembly portion in a first rotational direction and preventing rotation of the driveshaft in a second rotational direction opposite to the first rotational direction.

2. The clutch assembly of claim 1, further comprising a diverter valve mechanism having an open configuration, in which at least some fluid within the fluid passage is diverted to an annulus between the clutch assembly and the wellbore, and a closed configuration in which the fluid is not diverted to the annulus.

3. The clutch assembly of claim 2, wherein the first drill string section is above the clutch assembly and the second drill string section is below the clutch assembly, and wherein the first assembly portion is an upper subassembly coupled to the first drill string section, and the driveshaft is coupled to the second drill string section.

4. The clutch assembly of claim 3, wherein:

the upper subassembly comprises a housing, wherein the driveshaft is at least partially received in the housing;

the first coupling element is rotationally locked with the driveshaft; and the second coupling element is rotationally locked with the housing and axially movable between an engaged configuration in which the second coupling element engages the first coupling element such that the driveshaft is rotationally locked with the housing, and a disengaged configuration in which the second coupling element is disengaged from the first coupling element such that the driveshaft is rotatable relative to the housing.

5. The clutch assembly of claim 4, wherein the upper subassembly comprise an actuation mechanism, the actuation mechanism comprising at least one actuation member coupled to the second coupling element and selectively movable between first and second longitudinal positions within the housing to thereby axially move the second coupling element between the engaged and disengaged configurations.

6. The clutch assembly of claim 5, wherein the movement of the at least one actuation member between the first and second longitudinal positions further actuates the diverter valve mechanism between the opened and closed configurations.

7. The clutch assembly of claim 6, wherein:

the at least one actuation member comprises a pushrod defining a pushrod passage axially therethrough, and an actuation piston coupled to the pushrod, the actuation piston and the pushrod being movable between the first and second longitudinal positions, the actuation piston defining a piston passage axially therethrough, the fluid passage including the pushrod passage and the piston passage; and the actuation mechanism further comprises a biasing mechanism that provides a biasing force that biases the pushrod and the actuation piston in an uphole direction.

8. The clutch assembly of claim 7, wherein the actuation piston comprises a seat for landing a plug member to block fluid flow through the fluid passage and create a pressure differential that, at a first pressure threshold, overcomes the biasing force and moves the pushrod and actuation piston in a downhole direction.

9. The clutch assembly of claim 8, wherein the seat is configured to release the plug member at a second pressure threshold, wherein the second pressure threshold is higher than the first pressure threshold.

10. The clutch assembly of claim 9, wherein the seat comprises a deformable collar that deforms at a second pressure threshold to release the plug member.

11. The clutch assembly of claim 8, wherein the plug member comprises a deformable material such that the plug member deforms and passes through the seat at a second pressure threshold, wherein the second pressure threshold is higher than the first pressure threshold.

12. The clutch assembly of claim 8, wherein:

the actuation piston comprises a piston sleeve within a section of the housing, the valve mechanism comprising the piston sleeve and the section of the housing;

the piston sleeve defines one or more piston ports extending radially through the piston sleeve and in fluid communication with the piston passage;

the section of the housing defines one or more housing ports extending radially through the section of the housing;

when the pushrod and the actuation piston are in the first longitudinal position, the valve mechanism is in the closed configuration with each of the one or more piston ports axially offset from a respective one of the one or more housing ports such that each of the one or more piston ports is not in fluid communication with the respective housing port; and when the pushrod and the actuation piston are in the second longitudinal position, the valve mechanism is in the opened configuration with each of the one or more piston ports is aligned with the respective one of the one or more housing ports such that each of the one or more piston ports is in fluid communication with the respective housing port.

13. The clutch assembly of claim 5, wherein the actuation mechanism further comprises a latch mechanism that releasably holds the at least one actuation member in the first and second longitudinal positions.

14. A clutch assembly for use in a wellbore and connectable between a first drill string section and a second drill string section, the clutch assembly comprising:

a first assembly portion connectable to the first drill string section;

a second assembly portion connectable to the second drill string section, the first assembly portion and the second assembly portion collectively defining a fluid passage therethrough from a first end of the clutch assembly to a second end of the clutch assembly;

a releasable clutch mechanism coupling the first and second assembly portions, the first assembly portion comprising a first coupling element of the clutch mechanism, and the second assembly portion comprising a second coupling element of the clutch mechanism, the second coupling element being selectively engageable with the first coupling element, wherein:

the first assembly portion comprises;

an actuation member coupled to the second coupling element and selectively movable between first and second longitudinal positions to thereby axially move the second coupling element between the engaged and disengaged configurations, the actuation member defining an actuation member passage therethrough, the fluid passage through the clutch assembly including the actuation member passage;

a biasing mechanism that provides a biasing force that biases the actuation member in an uphole direction; and a plug catch portion comprising a seat for landing and releasably holding a plug member to block fluid flow through the actuation member passage and create a pressure differential that, at a first pressure threshold, overcomes the biasing force and moves the actuation member in a downhole direction.

15. The clutch assembly of claim 14, wherein the first assembly portion is an upper subassembly, and the first drill string section is above the clutch assembly, and wherein the second assembly portion comprises a driveshaft, and the second drill string section is below the clutch assembly.

16. The clutch assembly of claim 15, wherein the seat is configured to release the plug member at a second pressure threshold, wherein the second pressure threshold is higher than the first pressure threshold, wherein the seat comprises a deformable collar that deforms at a second pressure threshold to release the plug member.

17. The clutch assembly of claim 15, wherein the plug member comprises a deformable material that deforms and passes through the seat at a second pressure threshold, wherein the second pressure threshold is higher than the first pressure threshold.

18. The clutch assembly of claim 14, further comprising a diverter valve mechanism having an open configuration, in which at least some fluid within the fluid passage is diverted to an annulus between the clutch assembly and the wellbore, and a closed configuration in which the fluid is not diverted to the annulus, wherein the diverter valve mechanism comprises one or more ports in fluid communication with the annulus and the actuation member passage when the diverter valve mechanism is in the open configuration.

19. The clutch assembly of claim 18, wherein the plug seat is positioned uphole of the one or more ports.

20. A method of using a clutch assembly connected between first and second drill string sections, the clutch assembly comprising:

a first assembly portion connectable to the first drill string section;

a second assembly portion connectable to the second drill string section and comprising a driveshaft, the first assembly portion and the second assembly portion collectively defining a fluid passage therethrough from a first end of the clutch assembly to a second end of the clutch assembly;

a releasable clutch mechanism that selectively rotationally locks the first assembly portion with the second assembly portion, the first assembly portion comprising a first coupling element of the clutch mechanism, and the second assembly portion comprising a second coupling element of the clutch mechanism, the second coupling element being selectively engageable with the first coupling element;

a one-way bearing assembly allowing rotation of the driveshaft relative to the first assembly portion in a first rotational direction and preventing rotation of the driveshaft in a second rotational direction opposite to the first rotational direction, and the method comprising:

performing a drilling operation with the clutch mechanism engaged; and disengaging the clutch mechanism.

21. The method of claim 20, wherein:

the clutch assembly further comprises a diverter valve mechanism having an open configuration, in which at least some fluid within the fluid passage is diverted to an annulus between the clutch assembly and a wellbore, and a closed configuration in which the fluid is not diverted to the annulus;

the step of performing the drilling operation with the clutch mechanism engaged comprises performing the drilling operation with the clutch mechanism engaged and the diverter valve mechanism in the closed configuration; and the step of disengaging the clutch mechanism comprises disengaging the clutch mechanism and actuating the diverter valve mechanism from the closed configuration to the open configuration.

22. The method of claim 20, wherein:

the clutch assembly comprises an actuation mechanism comprising an actuation piston, the actuation piston comprising a seat; and disengaging the clutch mechanism comprises landing a plug member on the seat, thereby blocking fluid flow through the fluid passage and causing pressure above the seat to meet a first pressure threshold.

23. The method of claim 21, further comprising re-engaging the clutch mechanism and actuating diverter valve mechanism to the closed configuration.

24. The method of claim 22, wherein disengaging the clutch mechanism further comprises releasing the plug member from the seat when the pressure meets a second pressure threshold higher than the first pressure threshold, thereby resuming the fluid flow through the fluid passage.

* * * * *